US010981739B2

(12) United States Patent
Morikawa

(10) Patent No.: US 10,981,739 B2
(45) Date of Patent: Apr. 20, 2021

(54) MEDIUM CONVEYANCE DEVICE

(71) Applicant: PFU Limited, Ishikawa (JP)

(72) Inventor: Shuichi Morikawa, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 12 days.

(21) Appl. No.: 16/513,278

(22) Filed: Jul. 16, 2019

(65) Prior Publication Data

US 2019/0337744 A1 Nov. 7, 2019

Related U.S. Application Data

(63) Continuation of application No. PCT/JP2017/001672, filed on Jan. 19, 2017.

(51) Int. Cl.

| | |
|---|---|
| ***B65H 5/06*** | (2006.01) |
| ***B65H 7/02*** | (2006.01) |
| ***B65H 29/60*** | (2006.01) |

(52) U.S. Cl.

CPC ..... *B65H 7/02* (2013.01); *B65H 5/062* (2013.01); *B65H 29/60* (2013.01)

(58) Field of Classification Search

CPC ..... B65H 7/02; B65H 7/12; B65H 2511/13; B65H 2404/144; B65H 5/062; B65H 2402/52; B65H 5/06; B65H 2404/1341; G03G 15/5029

See application file for complete search history.

(56) References Cited

U.S. PATENT DOCUMENTS 5,029,845 A * 7/1991 Simpson-Davis ..... B65H 7/12 271/262
5,743,521 A * 4/1998 Munakata ..... B65H 5/062 271/263

FOREIGN PATENT DOCUMENTS

| | | | |
|---|---|---|---|
| JP | 52-068584 | U | 5/1977 |
| JP | 58-114245 | U | 8/1983 |
| JP | 3-103751 | U | 10/1991 |
| JP | 4-41349 | A | 2/1992 |
| JP | 4-159941 | | 6/1994 |
| JP | 9-240872 | A | 9/1997 |
| JP | 2001-116506 | A | 4/2001 |
| JP | 2005-231836 | A | 9/2005 |

(Continued)

OTHER PUBLICATIONS

International Search Report issued in corresponding International Patent Application No. PCT/JP2017/001672, dated Apr. 18, 2017.

*Primary Examiner* — Luis A Gonzalez
(74) *Attorney, Agent, or Firm* — McDermott Will & Emery LLP

(57) ABSTRACT

A medium conveyance device includes a drive roller that conveys an original in first direction, a guide in which a first surface and a second surface are formed, a slider in which a first point and a second point are formed, a pinch roller that is rotatably supported by a pinch shaft that is fixed to the slider and that pushes the original against the drive roller, and a sensor that measures a thickness of the original based on an amount of move of the slider in a second direction that is different from the first direction, wherein the first point slides on the first surface and the second point slides on the second surface and accordingly the slider is supported on the guide movably in the second direction, and a distance between the first point and the second point is longer than a diameter of the pinch shaft.

3 Claims, 16 Drawing Sheets

(56) References Cited

FOREIGN PATENT DOCUMENTS

| | | | |
|---|---|---|---|
| JP | 2009-161313 | A | 7/2009 |
| JP | 2009-203001 | A | 9/2009 |
| JP | 2011-026080 | A | 2/2011 |
| JP | 2013-052929 | A | 3/2013 |

* cited by examiner

MEDIUM CONVEYANCE DEVICE

CROSS-REFERENCE TO RELATED APPLICATION

This application is a continuation of International Application No. PCT/JP2017/001672, filed on Jan. 19, 2017, the entire contents of which are incorporated herein by reference.

FIELD

The disclosed technology relates to a medium conveyance device.

BACKGROUND

Image read devices in which a return path on which an original is conveyed while curving is formed are known. In such an image read device, it is possible to arrange an original table on which originals to be fed near a stacker on which ejected originals are placed, thereby reducing a setting space. In the image read device, a straight path on which an original is conveyed without curving is further formed. The image read device measures the thickness of the original based on an amount of displacement of a roller that is used to convey the original and, based on the measured thickness, switches between ejecting the original to the straight path and ejecting the original to the return path (see Japanese Laid-open Patent Publication No. 2009-203001, Japanese Laid-open Patent Publication No. 2011-026080 and Japanese Laid-open Patent Publication No. 2013-052929).

There is however a problem in that the thickness thus measured is less accurate when the pinch roller is not displaced properly.

SUMMARY

According to an aspect of an embodiment, a medium conveyance device includes a drive roller that rotates, a guide in which a first sliding surface and a second sliding surface are formed, a slider in which a first contact point and a second contact point are formed, a pinch roller that is supported on the slider rotatably via a pinch shaft and that pushes an original against the drive roller, and a sensor that measures a thickness of the original based on an amount of move of the slider in a second direction that is different from a first direction in which the original is conveyed, wherein the slider is supported on the guide such that the first contact point slides on the first sliding surface and the second contact point slides on the second sliding surface and accordingly the slider is movable in the second direction, and a distance between the first contact point and the second contact point in the second direction is longer than a diameter of the pinch shaft.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Preferred embodiments of the disclosure be explained with reference to accompanying drawings. With reference to the accompanying drawings, medium conveyance devices according to embodiments disclosed herein will be described below. The following description does not limit the disclosure. In the following description, the same components are denoted with the same reference numbers and redundant description will be omitted.

First Embodiment

Figure 1:
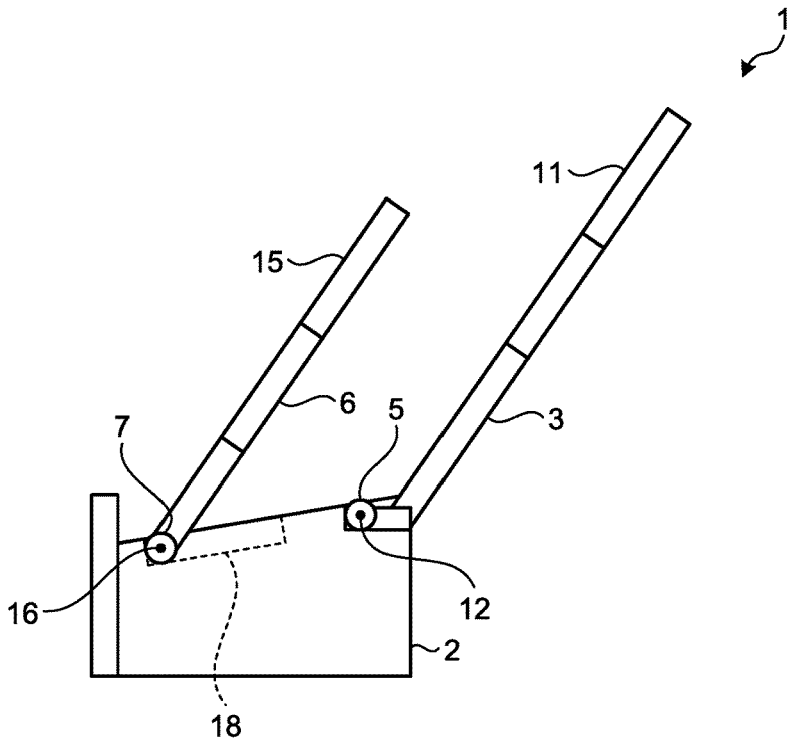
FIG. 1 is a side view of a medium conveyance device of a first embodiment.

FIG. 1 is a side view of a medium conveyance device 1 of a first embodiment. The medium conveyance device 1 is used as an image read device and, as illustrated in FIG. 1, includes a casing 2, a shooter 3 a shooter supporter 5, a stacker 6, and a stacker supporter 7. The casing 2 is formed into a box shape and forms an outer shell of the body of the medium conveyance device 1. The casing 2 is placed on a setting surface on which the medium conveyance device 1 is set. The shooter 3 is formed into a platy shape and a shooter placement surface 11 that is approximately flat is formed in the shooter 3. The shooter 3 is arranged behind and above the casing 2 (on the right side in FIG. 1) such that, when the surface on which the medium conveyance device 1 is set is horizontal, the shooter placement surface 11 is oriented obliquely upward and the angle formed by the shooter placement surface 11 and the surface on which the medium conveyance device 1 is set is equal to 55 degrees. The shooter supporter 5 supports the shooter 3 such that the shooter 3 is able to turn about a rotation axis 12 with respect to the casing 2. The rotation axis 12 is parallel with the surface on which the medium conveyance device 1 is set and is parallel with the shooter placement surface 11. The shooter supporter 5 further inhibits the shooter 3 from turning such that the angle formed by the shooter placement surface 11 and the surface on which the medium conveyance device 1 is set is not smaller than 55 degrees. In other words, the shooter supporter 5 supports the shooter 3 such that the shooter 3 does not turn clockwise about the rotation axis 12 from the state illustrated in FIG. 1 because of the force of gravity.

The stacker 6 is formed into a platy shape, and a stacker placement surface 15 that is approximately flat is formed in the stacker 6. The stacker 6 is arranged on an upper part of the casing 2 on the front side (the left side in FIG. 1) such that the stacker placement surface 15 is approximately parallel with the shooter placement surface 11. In other words, the stacker 6 is arranged such that the stacker placement surface 15 is oriented obliquely upward and the angle formed by the stacker placement surface 15 and the surface on which the medium conveyance device 1 is set is equal to 55 degrees. The stacker 6 is arranged as described above and thus covers part of the shooter placement surface 11. The stacker supporter 7 supports the stacker 6 such that the stacker 6 is able to turn about a rotation axis 16 with respect to the casing 2. The rotation axis 16 is parallel with the rotation axis 12 and, in other words, is parallel with the surface on which the medium conveyance device 1 is set and is parallel with the stacker placement surface 15. The stacker supporter 7 further inhibits the stacker 6 from turning such that the angle formed by the stacker placement surface 15 and the surface on which the medium conveyance device 1 is set is not larger than 55 degrees. In other words, the stacker supporter 7 supports the stacker 6 such that the stacker 6 does not turn counterclockwise about the rotation axis 16 from the state illustrated in FIG. 1.

In the medium conveyance device 1, a stacker storage area 18 is formed. The stacker storage area 18 is formed between the shooter 3 and the stacker 6 in the upper part of the casing 2. In other words, the stacker storage area 18 is arranged on the back side of the upper part of the casing 2 with respect to the rotation axis 16 of the stacker 6 and is arranged on the front side of the upper part of the casing 2 with respect to the rotation axis 12 of the shooter 3.

Figure 2:
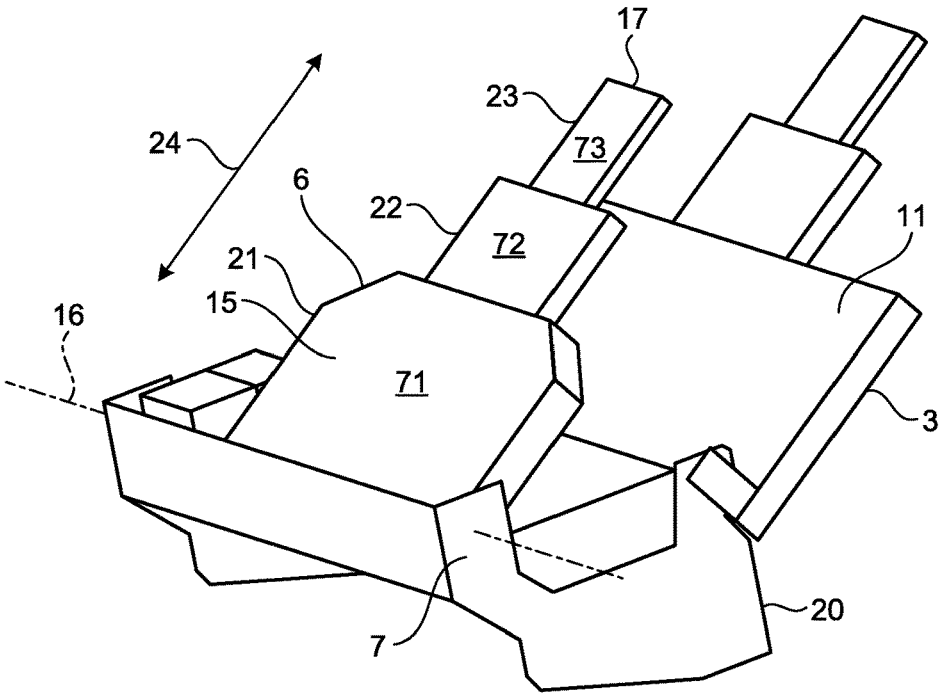
FIG. 2 is a perspective view of a shooter and a stacker.

FIG. 2 is a perspective view of the shooter 3 and the stacker 6. As illustrated in FIG. 2, the medium conveyance device 1 further includes a frame 20. The frame 20 is fixed to the body of the medium conveyance device 1 and, specifically, is arranged in the casing 2 and is fixed to the casing 2. The stacker 6 includes a first stacker member 21, a second stacker member 22, and a third stacker member 23. The first stacker member 21 is formed into a platy shape and a first stacker placement surface 71 is formed in the first stacker member 21. The first stacker member 21 is supported by the stacker supporter 7 and on the frame 20 such that the first stacker member 21 is able to turn about the rotation axis 16.

The second stacker member 22 is formed into a platy shape that is thinner than the first stacker member 21 and a second stacker placement surface 72 is formed in the second stacker member 22. The second stacker member 22 is supported on the first stacker member 21 movably in parallel with an extension-contraction direction 24 such that the second stacker member 22 is arranged in an extension position or a contraction position. The extension-contraction direction 24 is orthogonal to the rotation axis 16 and is parallel with the stacker placement surface 15. The second stacker member 22 is pulled out of the first stacker member 21 and accordingly is arranged in the extension position and the second stacker member 22 is pushed into the first stacker member 21 and accordingly is arranged in the contraction position. The second stacker member 22 is arranged in the contraction position and accordingly the second stacker placement surface 72 overlaps the first stacker placement surface 71, and the second stacker member 22 is arranged in the extension position and accordingly the second stacker placement surface 72 is aligned with the first stacker placement surface 71.

The third stacker member 23 is formed into a platy shape thinner than the second stacker member 22, and a third stacker placement surface 73 is formed in the third stacker member 23. The third stacker member 23 is supported on the second stacker member 22 movably in parallel with the extension-contraction direction 24 such that the third stacker member 23 is arranged in an extension position or a contraction position. The third stacker member 23 is pulled out of the second stacker member 22 and accordingly is arranged in the extension position, and the third stacker member 23 is pushed into the second stacker member 22 and accordingly is arranged in the contraction position. The third stacker member 23 is arranged in the contraction position and accordingly the third stacker placement surface 73 overlaps the second stacker placement surface 72, and the third stacker member 23 is arranged in the extension position and accordingly the third stacker placement surface 73 is aligned with the second stacker placement surface 72. The stacker 6 is formed in this manner and thus is formed to be contractible such that a stacker end 17 on the distal side with respect to the rotation axis 16 moves close to the rotation axis 16 and to be extensible such that the stacker end 17 moves away from the rotation axis 16. The second stacker member 22 is arranged in the extension position and the third stacker member 23 is arranged in the extension position and accordingly the first stacker placement surface 71, the second stacker placement surface 72, and the third stacker placement surface 73 are formed on the stacker placement surface 15.

The stacker 6 further includes an interlock mechanism (not illustrated in FIG. 2). The interlock mechanism mechanically converts motion of the second stacker member 22 to be pulled out of the first stacker member 21 into motion of the third stacker member 23 to be pulled out of the second stacker member 22. The interlock mechanism further mechanically converts motion of the second stacker member 22 to be pushed into the first stacker member 21 into motion of the third stacker member 23 to be pushed into the second stacker member 22. The interlock mechanism enables the second stacker member 22 to be pulled out of the first stacker member 21 and pushed into the first stacker member 21 and accordingly the stacker 6 extends and contracts.

Figure 3:
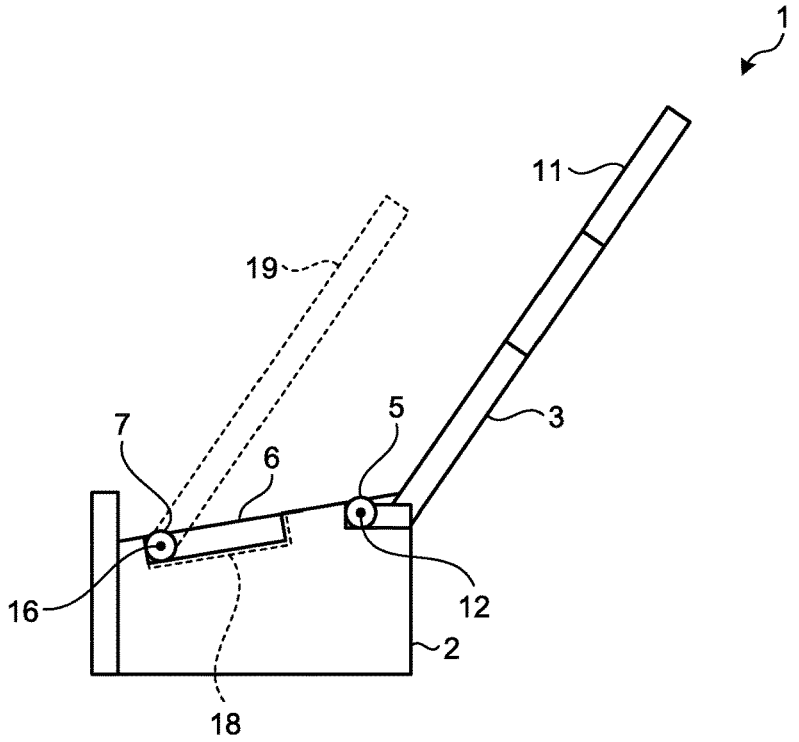
FIG. 3 is a side view of the medium conveyance device in the case where the stacker is stored.

FIG. 3 as a side view of the medium conveyance device 1 in the case where the stacker 6 is housed in the stacker storage area 18. As illustrated in FIG. 3, when caused to contract, the stacker 6 is turned about the rotation axis 16 and accordingly is arranged and stored in the stacker storage area 18. In other words, the stacker supporter 7 supports the stacker 6 movably such that the stacker 6 is arranged in the stacker storage area 18 or a stacker development area 19. The stacker development area 19 is an area where the stacker 6 is arranged in FIG. 1. In other words, the stacker 6 is arranged in the stacker development area 19 and accordingly the stacker placement surface 15 is oriented obliquely upward and the angle formed by the stacker placement surface 15 and the surface on which the medium conveyance device 1 is set is approximately equal to 55 degrees.

The stacker 6 is arranged in the stacker storage area 18 and accordingly the shooter placement surface 11 is exposed and, compared to the case where the stacker 6 is arranged in the stacker development area 19, it is possible to reduce the area covered with the stacker 6 in the shooter placement surface 11. In other words, the area of a diagram obtained by orthogonally projecting the stacker 6 that is arranged in the stacker storage area 18 onto the shooter placement surface 11 is smaller than the area of a diagram obtained by orthogonally projecting the stacker 6 that is arranged in the stacker development area 19 onto the shooter placement surface 11.

Figure 4:
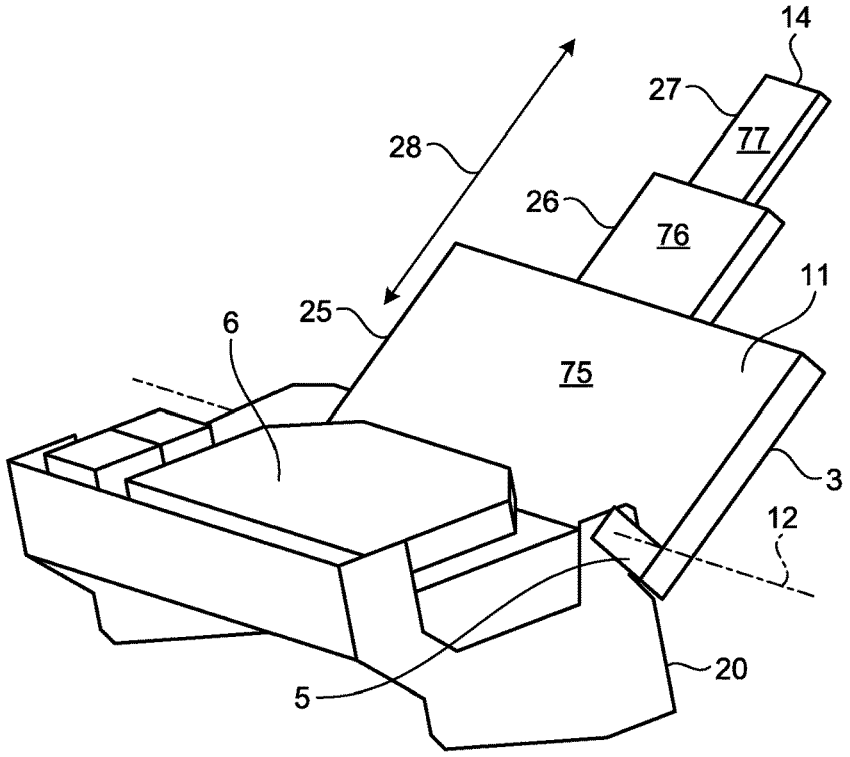
FIG. 4 is a perspective view of the stacker and the shooter in the case where the stacker is stored.

FIG. 4 a perspective view of the stacker 6 and the shooter 3 in the case where the stacker 6 is stored in the stacker storage area 18. As illustrated in FIG. 1, the shooter 3 includes a first shooter member 25, a second shooter member 26, and a third shooter member 27. The first shooter member 25 is formed into a platy shape, and a first shooter placement surface 75 is formed in the first shooter member 25. The first shooter member 25 is supported by the shooter supporter 5 and on the frame 20 such that the first shooter member 25 is able to turn about the rotation axis 12 to be arranged in a shooter development position or a shooter storage position. The first shooter member 25 is arranged in the shooter development position when the shooter placement surface 11 is oriented obliquely upward.

The second shooter member 26 is formed into a platy shape thinner than the first shooter member 25, and a second shooter placement surface 76 is formed in the second shooter member 26. The second shooter member 26 is supported on the first shooter member 25 movably in parallel with an extension-contraction direction 28 to be arranged in an extension position or a contraction position. The extension-contraction direction 28 is orthogonal to the rotation axis 12 and is parallel with the shooter placement surface 11. The second shooter member 26 is pulled out of the first shooter member 25 and accordingly is arranged in the extension position. The second shooter member 26 is pushed into the first shooter member 25 and accordingly is arranged in the contraction position. The second shooter placement surface 76 is arranged in the contraction position and accordingly overlaps the first shooter placement surface 75, and the second shooter placement surface 76 is arranged in the extension position and accordingly is aligned with the first shooter placement surface 75.

The third shooter member 27 is formed into a platy shape thinner than the second shooter member 26, and a third shooter placement surface 77 is formed in the third shooter member 27. The third shooter member 27 is supported on the second shooter member 26 movably in parallel with the extension-contraction direction 28 such that the third shooter member 27 is arranged in an extension position or a contraction position. The third shooter member 27 is pulled out of the second shooter member 26 and accordingly is arranged in the extension position. The third shooter member 27 is pushed into the second shooter member 26 and accordingly is arranged in the contraction position. The third shooter placement surface 77 is arranged in the contraction position and accordingly overlaps the second shooter placement surface 76, and the third shooter placement surface 77 is arranged in the extension position and accordingly is aligned with the second shooter placement surface 76. The shooter 3 is formed as described above and thus is formed to be contractible such that a shooter end 14 on the distal side with respect to the rotation axis 12 moves close to the rotation axis 12 and to be extensible such that the shooter end 14 moves away from the rotation axis 12. The second shooter member 26 is arranged in the extension position and the third shooter member 27 is arranged in the extension position and accordingly the first shooter placement surface 75, the second shooter placement surface 76, and the third shooter placement surface 77 are formed on the shooter placement surface 11.

Figure 5:
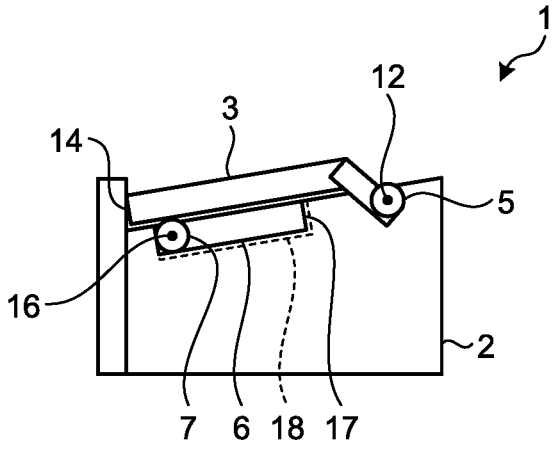
FIG. 5 is a side view of the medium conveyance device in the case where the shooter is stored.
Figure 6:
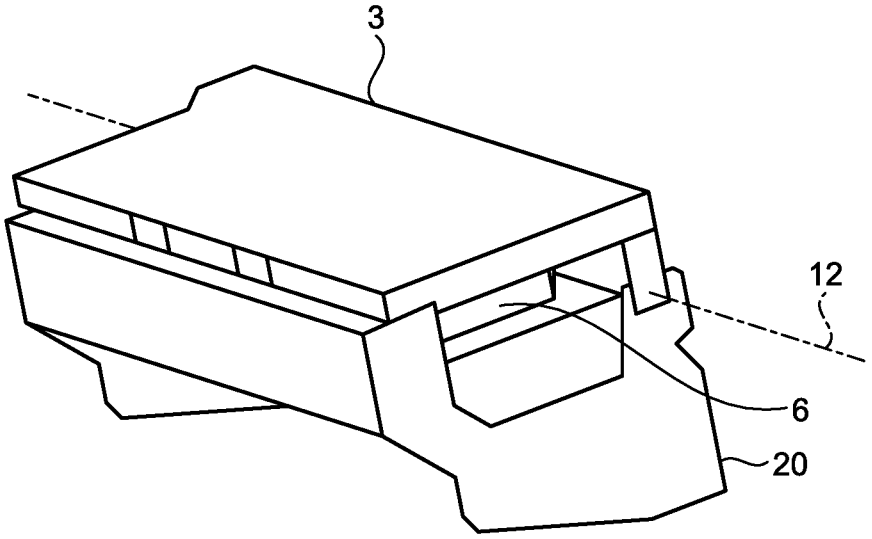
FIG. 6 is a perspective view of the stacker and the shooter in the case where the shooter is stored.

FIG. 5 is a side view of the medium conveyance device 11 in the case where the shooter 3 is stored. FIG. 6 is a perspective view of the stacker 6 and the shooter 3 in the case where the shooter 3 is stored. As illustrated in FIG. 5, when the shooter 3 contracts in the case where the stacker 6 is stored in the stacker storage area 18, the shooter 3 is storable above the stacker 6. In other words, when the shooter 3 is stored, the first shooter member 25 is arranged in the shooter storage position and the first shooter placement surface 75 is opposed to the stacker 6. When the first shooter member 25 is arranged in the shooter storage position, the second shooter member 26 is arranged in the contraction position and is pushed into the first shooter member 25. When the second shooter member 26 is arranged in the contraction position, the third shooter member 27 is arranged in the contraction position and is pushed into the second shooter member 26. Storing the shooter 3 reduces the height of the medium conveyance device 1, thereby reducing the size. Storing the shooter 3 further enables the shooter 3 to cover the stacker 6 as illustrated in FIG. 6.

The shooter 3 further includes an interlock mechanism (not illustrated in the drawings). The interlock mechanism mechanically converts motion of the first shooter member 25 to turn to the shooter storage position into motion of the second shooter member 26 to move to the contraction position. The interlock mechanism further mechanically converts motion of the second shooter member 26 to move to the contraction position into motion of the third shooter member 27 to move to the contraction position. The interlock mechanism further mechanically converts motion of the first shooter member 25 to turn to the shooter development position into motion of the second shooter member 26 to move to the extension position. The interlock mechanism further converts motion of the second shooter member 26 to move to the extension position into motion of the third shooter member 27 to move to the extension position.

Figure 7:
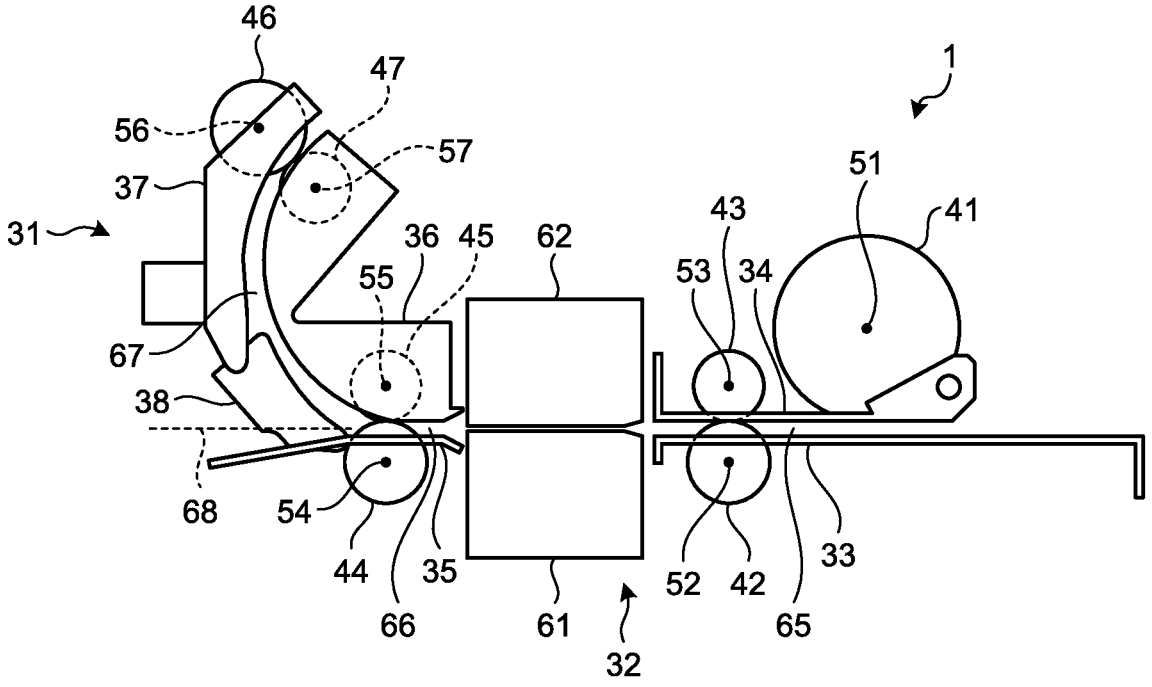
FIG. 7 is a cross-sectional view of the conveyance device and a read device.

FIG. 7 is a cross-sectional view of a conveyance device 31 and a read device 32. As illustrated in FIG. 7, the medium conveyance device 1 further includes the conveyance device 31 and the read device 32.

Conveyance Device

The conveyance device 31 is arranged in the casing 2. The conveyance device 31 includes a plurality of conveyance guides 33 to 37, a switch guide 38, and a plurality of conveyance rollers 41 to 47. The conveyance guides 33 to 37 include a first conveyance guide 33, a second conveyance guide 34, a third conveyance guide 35, a fourth conveyance guide 36, and a fifth conveyance guide 37. The first conveyance guide 33 is formed into a platy shape that is approximately flat. The first conveyance guide 33 is arranged along a plane that is approximately parallel with the surface on which the medium conveyance device 1 is set and the first conveyance guide 33 is fixed to the frame 20. The second conveyance guide 34 is formed into a platy shape that is approximately flat. The second conveyance guide 34 is arranged above the first conveyance guide 33 such that the second conveyance guide 34 is opposed to the first conveyance guide 33. The second conveyance guide 34 is further supported on the frame 20 such that the second conveyance guide 34 is able to ascend and descend in the vertical direction that is orthogonal to a plane along which the first conveyance guide 33 is.

The third conveyance guide 35 is formed into an approximately platy shape. The third conveyance guide 35 is arranged in front of the first conveyance guide 33 such that the third conveyance guide is along the plane along which the first conveyance guide 33 is and is fixed to the frame 20. The fourth conveyance guide 36 is formed into a pillar shape and a convex surface along part of a side surface of the cylinder is formed in the fourth conveyance guide 36. The fourth conveyance guide 36 is arranged above the third conveyance guide 35 such that part of the convex surface is opposed to the third conveyance guide 35. The fourth conveyance guide 36 is fixed to the frame 20. The fifth conveyance guide 37 is formed into a pillar shape and a concave surface along part of the side surface of the cylinder is formed in the fifth conveyance guide 37. The fifth conveyance guide 37 is arranged in front of the fourth conveyance guide 36 such that the concave surface of the fifth conveyance guide 37 is opposed to part of the convex surface of the fourth conveyance guide 36.

The conveyance device 31 includes the conveyance guides 33 to 37 and thus a conveyance path 65, a conveyance path 66, a return conveyance path 67, and a straight conveyance path 68 are formed. The conveyance path 65 is formed between the first conveyance guide 33 and the second conveyance guide 34. The conveyance path 65 is formed along a plane that is parallel with the surface on which the medium conveyance device 1 is set. The conveyance path 65 is formed further to be connected to the shooter placement surface 11 when the shooter 3 is developed. The conveyance path 66 is formed between the third conveyance guide 35 and the fourth conveyance guide 36. The conveyance path 66 is formed along the plane along the conveyance path 65.

The return conveyance path 67 is formed between the fourth conveyance guide 36 and the fifth conveyance guide 37. The return conveyance path 67 is formed along the side surface of the cylinder. The return conveyance path 67 is formed further such that, when the stacker 6 is arranged in the stacker development area 19, the return conveyance path 67 is connected to the stacker placement surface 15. The straight conveyance path 68 is formed under the fifth conveyance guide 37. The straight conveyance path 68 is formed along the plane along the conveyance path 65. The straight conveyance path 68 is formed further to be connected to the outside of the casing 2.

The switch guide 38 is formed to be in an approximately platy shape and is supported on the frame 20 movably to be arranged in a return path guide position or a straight path guide position. The switch guide 38 is arranged in the return path guide position and accordingly connects the conveyance path 66 to the return conveyance path 67. The switch guide 36 is arranged in the straight path guide position and accordingly connects the conveyance path 66 to the straight conveyance path 68.

The conveyance rollers 41 to 47 include a pick roller 41, a first drive roller 42, a first pinch roller 43, a second drive roller 44, a second pinch roller 45, a third drive roller 46, and a third pinch roller 47. The pick roller 41 is formed into a cylindrical shape and is arranged above the conveyance path 65. The pick roller 41 is supported on the frame 20 rotatably about a rotation axis 51. The rotation axis 51 is parallel with the rotation axis 12. Furthermore, the pick roller 41 is arranged to contact an original that is placed on the shooter placement surface 11 of the developed shooter 3. The pick roller 41 rotates normally (clockwise in FIG. 7) about the rotation axis 51 and accordingly one of a plurality of originals placed on the shooter placement surface 11 that contacts the pick roller 41 is conveyed to the conveyance path 65.

The first drive roller 42 is formed into a cylindrical shape and is arranged under the conveyance path 65 and in front of the pick roller 41. The first drive roller 42 is supported on the frame 20 rotatably about a rotation axis 52. The rotation axis 52 is parallel with the rotation axis 51. The first pinch roller 43 is formed into a cylindrical shape and is arranged above the first drive roller 42. The first pinch roller 43 is supported on the frame 20 such that the first pinch roller 43 is rotatable about a rotation axis 53 and is able to ascend and descend vertically. The rotation axis 53 is parallel with the rotation axis 52. The first drive roller 42 and the first pinch roller 43 are arranged further such that the original conveyed on the conveyance path 65 is interposed between the first drive roller 42 and the first pinch roller 43. The first drive roller 42 rotates normally (counterclockwise in FIG. 7) about the rotation axis 52 and the original that is conveyed on the conveyance path 65 is pushed by the first pinch roller 43 against the first drive roller 42 and accordingly is conveyed to the conveyance path 66. The original conveyed on the conveyance path 65 contacts the second conveyance guide 34 and accordingly the second conveyance guide 34 ascends and descends with respect to the frame 20 to be arranged at a level corresponding to the thickness of the original. In other words, the thicker the original conveyed on the conveyance path. 65 is, the higher the level at which the second conveyance guide 34 is arranged is. The first pinch roller 43 ascends and descends to be arranged at a level corresponding to the thickness of the original conveyed on the conveyance path 65. In other words, the thicker the original conveyed on the conveyance path 65 is, the higher the level at which the first pinch roller 43 is arranged is.

The second drive roller 44 is formed into a cylindrical shape and is arranged under the conveyance path 66. The second drive roller 44 is supported on the frame 20 rotatably about a rotation axis 54. The rotation axis 54 as parallel with the rotation axis 51. The second pinch roller 45 is formed into a cylindrical shape and is arranged above the conveyance path 66. The second pinch roller 45 is supported on the frame 20 such that the second pinch roller 45 is rotatable about a rotation axis 55 and is able to ascend and descend vertically. The rotation axis 55 is parallel with the rotation axis 54. The second drive roller 44 and the second pinch roller 45 are arranged further such that the original conveyed on the conveyance path 66 is interposed between the second drive roller 44 and the second pinch roller 45. The second drive roller 44 rotates normally (counterclockwise in FIG. 7) about the rotation axis 54 and the original conveyed on the conveyance path 66 is pushed by the second pinch roller 45 against the second drive roller 44 and accordingly is conveyed to the return conveyance path 67 or the straight conveyance path 68. The second pinch roller 45 ascends and descends to be arranged at the level corresponding to the thickness of the original conveyed on the conveyance path 66. In other words, the thicker the original conveyed on the conveyance path 66 is, the higher the level at which the second pinch roller 45 is arranged is.

The third drive roller 46 is formed into a cylindrical shape and is arranged in front of the return conveyance path 67. The third drive roller 46 is supported on the frame 20 rotatably about a rotation axis 56. The rotation axis 56 is parallel with the rotation axis 51. The third pinch roller 47 is formed into a cylindrical shape and is arranged behind the third drive roller 46. The third pinch roller 47 is supported on the frame 20 rotatably on a rotation axis 57. The rotation axis 57 is parallel with the rotation axis 56. The third drive roller 46 and the third pinch roller 47 are arranged further such that the original conveyed on the return conveyance path 67 is interposed between the third drive roller 46 and the third pinch roller 47. The third drive roller 46 rotates normally (counterclockwise in FIG. 7) and the original conveyed on the return conveyance path 67 is pushed by the third pinch roller 47 against the third drive roller 46 and accordingly is placed on the stacker placement surface 15 of the stacker 6 in the stacker development area 19.

The conveyance device 31 further includes a conveyance motor (not illustrated in FIG. 7). The conveyance motor causes the pick roller 41, the first drive roller 42, the second drive roller 44, and the third drive roller 46 to rotate normally or inversely.

The conveyance device 31 is configured as described above to convey the original arranged at the top of the originals placed on the shooter 3 to the conveyance paths 65 and 66. The conveyance device 31 further conveys the original that is conveyed from the conveyance path 66 to the return conveyance path 67 to the stacker 6 and places the original on the stacker placement surface 15. The surface of the original that is opposed to the shooter placement surface 11 when the original is placed on the shooter 3 is the back surface of the surface opposed to the stacker placement surface 15 when the original is placed on the stacker placement surface 15 of the stacker 6. The conveyance device 31 further ejects the original conveyed from the conveyance path 66 to the straight conveyance path 68 to the outside of the casing 2. Compared to the straight conveyance path 68, the degree of curve of the return conveyance path 67 is large. For this reason, the degree of deformation of the original passing through the return conveyance path 67 is larger than the degree of deformation of the original passing through the straight conveyance path 68.

The stacker 6 further includes another interlock mechanism (not illustrated in FIG. 7). When the pick roller 41, the first drive roller 42, the second drive roller 44, and the third drive roller 46 rotate normally, the interlock mechanism causes the first stacker member 21 to turn about the rotation axis 16 to be arranged in the stacker development area 19. The interlock mechanism holds the first stacker member 21 such that the first stacker member 21 is arranged in the stacker development area 19 during normal rotation of the pick roller 41, the first drive roller 42, the second drive roller 44, and the third drive roller 46. When the pick roller 41, the first drive roller 42, the second drive roller 44, and the third drive roller 46 rotate inversely, the interlock mechanism causes the first stacker member 21 to turn about the rotation axis 16 to be arranged in the stacker storage area 18.

Read Device

The read device 32 is arranged between the conveyance path 65 and the conveyance path 66 in the casing 2. The read device 32 includes a lower image sensor 61 and an upper image sensor 62. The lower image sensor 61 is arranged under the plane along which the conveyance path 65 and the conveyance path 66 are and is fixed to the frame 20. The lower image sensor 61 is formed of an image sensor of a contact image sensor (CIS) type. The lower image sensor 61 contacts a lower read surface of the original conveyed from the conveyance path 65 to the conveyance path 66 illuminates the read surface, and receives the light reflected on the read surface, thereby reading the image on the read surface. The upper image sensor 62 is arranged above the plane surface along which the conveyance path 65 and the conveyance path 66 are and is supported on the frame 20 movably in parallel with the vertical direction. The upper image sensor 62 is formed of a CIS type image sensor. The upper image sensor 62 illuminates an upper read surface of the original that is conveyed from the conveyance path 65 to the conveyance path 66 and receives the light reflected on the read surface, thereby reading the image on the read surface.

Configuration of Pinch Roller

Figure 8:
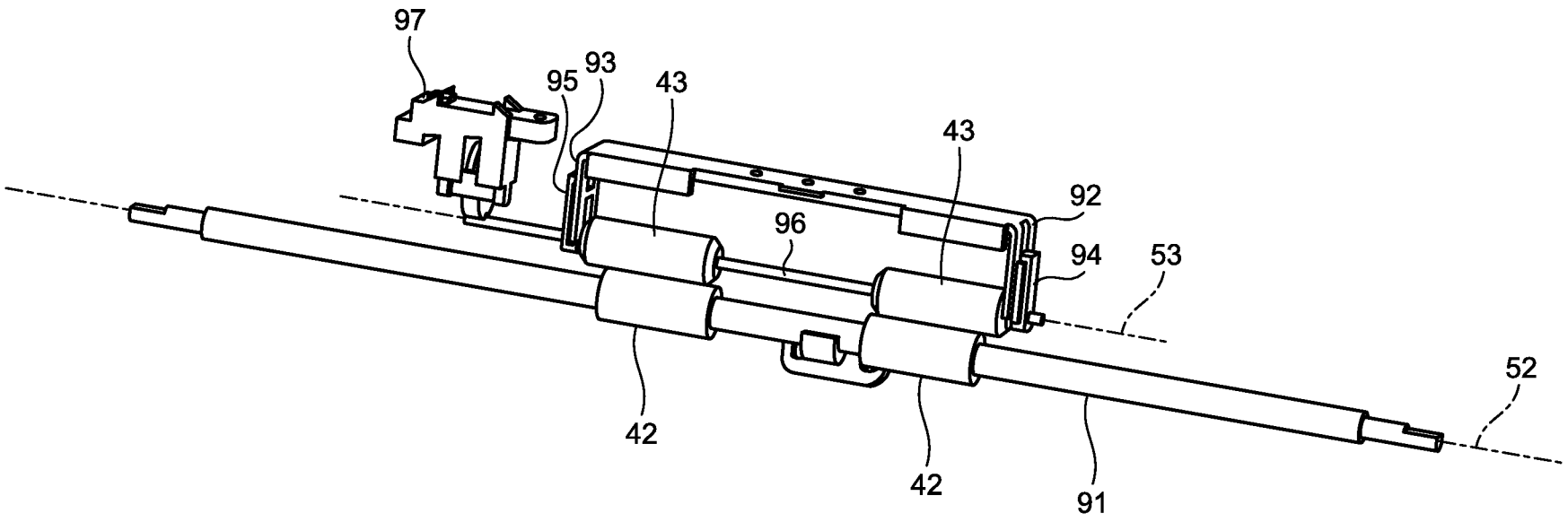
FIG. 8 is a perspective view of a first drive roller and a first pinch roller.

FIG. 8 is a perspective view of the first drive roller 42 and the first pinch roller 43. As illustrated in FIG. 8, the conveyance device 31 further includes a feed roller shaft 91, a first guide 92, a second guide 93, a first slider 94, a second slider 95, a pinch shaft 96, and a thickness sensor 97. The feed roller shaft 91 is formed into a bar shape and is supported on the frame 20 rotatably about a rotation axis 52 via a be (not illustrated in FIG. 8). The first drive roller 42 is fixed to the feed roller shaft 91 and thus is supported on the frame 20 rotatably about the rotation axis 52, and the conveyance motor of the conveyance device 31 causes the feed roller shaft 91 to rotate and accordingly the first drive roller 42 rotates about the rotation axis 52.

The first guide 92 is arranged in the casing 2 and fixed to the frame such that the first guide 92 and the first pinch roller 43 are aligned with the direction of the rotation axis 53. The second guide 93 is arranged in the casing 2 and is fixed to the frame 20 such that the first pinch roller 43 is arranged between the first guide 92 and the second guide 93. The first slider 94 is arranged along the first guide 92 and is supported on the first guide 92 such that the first slider 94 is able to ascend and descend. The second slider 95 is arranged along the second guide 93 and is supported on the second guide 93 such that the second slider 95 is able to ascend and descend.

The pinch shaft 96 is formed into a bar shape and is arranged along the rotation axis 53 in the casing 2. A through-hole is formed in the first pinch roller 43 and the pinch shaft 96 is slidably inserted into the through-hole and thus the first pinch roller 43 is supported on the pinch shaft 96 rotatably about the rotation axis 53. The pinch shaft 96 is partly fixed to the first slider 94 and the second slider 95 and thus is supported on the frame 20 such that the pinch shaft 96 is able to ascend and descend. The pinch shaft 96 is supported on the frame 20 such that the pinch shaft 96 is able to ascend and descend and thus the first pinch roller 43 is supported on the frame 20 such that the pinch shaft 96 is able to ascend and descend.

The thickness sensor 97 is arranged in the casing 2 and includes a fixed part and a movable part. The fixed part is fixed to the frame 20. The movable part is arranged such that the movable part contacts part of the pinch shaft 96, and the movable part is supported on the fixed part movably vertically. The movable part contacts part of the punch shaft 96 and thus moves along with the pinch shaft 96. The thickness sensor 97 measures a relative position in which the movable part is arranged with respect to the fixed part and, based on the measured relative position, measures a pinch shaft move amount by which the pinch shaft 96 moves. Based on the measured pinch shaft move amount, the thickness sensor 97 measures a slider move amount by which the first slider 94 moves. Based on the measured slider move amount, the thickness sensor 97 further measures the thickness of the original that is conveyed on the conveyance path 65.

Figure 9:
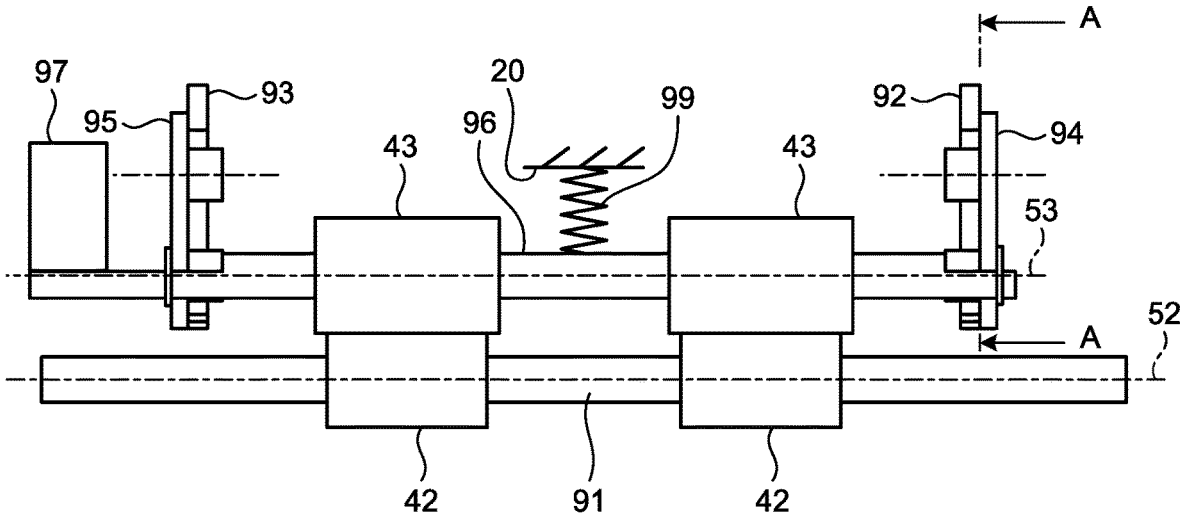
FIG. 9 is a schematic diagram of the first drive roller and the first pinch roller.

FIG. 9 is a schematic diagram of the first drive roller 42 and the first pinch roller 43. As illustrated in FIG. 9, the conveyance device 31 further includes a spring 99. One end of the spring 99 is fixed to the frame 20 and the other end is fixed to the approximate center of the pinch shaft 96. The spring 99 applies an elastic force to the pinch shaft 96 to cause the pinch shaft 96 to descend.

Figure 10:
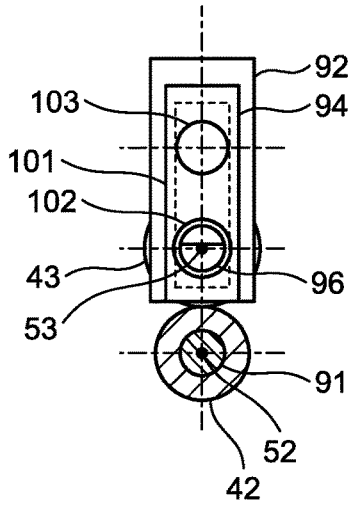
FIG. 10 is a side view of a first guide and a first slider.

FIG. 10 is side view of the first guide 92 and the first slider 94. As illustrated in FIG. 10, the first slider 94 includes a body part 101, a first pin part 102, and a second pin part 103. The body part 101 is formed into a platy shape. The first pin part 102 is formed into an approximately shape and is fixed to the body part 101. The first pin part 102 is further formed such that the pin part 102 surrounds part of the pinch shaft 96, and the pin part 102 is fixed to the pinch shaft 96. The second pin part 103 is formed into an approximately cylindrical shape as the first pin part 102 is. The second pin part 103 is arranged in a position apart from the first pin part 102 and is fixed to the body part 101.

Figure 11:
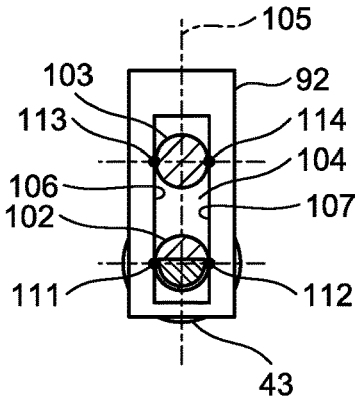
FIG. 11 is a cross-sectional view of FIG. 9, taken along the line A-A.

FIG. 11 is a cross-sectional view taken along the line A-A in FIG. 9. As illustrated in FIG. 11, a sliding groove 104 is formed in the first guide 92. The sliding groove 104 is formed along a straight line parallel with a straight, line 105 orthogonal to the rotation axis 52 and the rotation axis 53. In the sliding groove 104, a first sliding surface 106 and a second sliding surface 107 are formed. The first sliding surface 106 is one end surface that forms the sliding groove 104 and is formed along a plane that is parallel with the straight line 105. The second sliding surface 107 is another end surface that forms the sliding groove 104 and the second sliding surface 107 is formed such that the second sliding surface 107 is along the plane parallel with the straight line 105 and is opposed to the first sliding surface 106.

The first pin part 102 and the second pin part 103 are fitted in the sliding groove 104. In the first pin part 102, a first contact point 111 and a second contact point 112 are formed. The first contact point 111 is formed in part of the first pin part 102, which is part opposed to the first sliding surface 106 when the first pin part 102 is fitted in the sliding groove 104. The second contact point 112 is formed in part of the first pin part 102, which is part opposed to the second sliding surface 107 when the first pin part 102 is fitted in the sliding groove 104. The first pin part 102 is fitted in the sliding groove 104 and thus is guided to move along the sliding groove 104.

In the second pin part 103, a third contact point 113, and a fourth contact point 114 are formed. The third contact point 113 is formed in part of the second pin part 103, which is part opposed to the first sliding surface 106 when the second pin part 103 is fitted in the sliding groove 104. The fourth contact point 114 is formed in part of the second pin part 103, which is part opposed to the second sliding surface 107 when the second pin part 103 is fitted in the sliding groove 104. The second pin part 103 is fitted in the sliding groove 104 and thus is guided to move along the sliding groove 104. The second pin part 103 is arranged and is fixed to the body part 101 such that the distance between the first contact point 111 and the third contact point 113 (or the distance between the second contact point and the fourth contact point 114) is larger than the diameter of the pinch shaft 96.

The first pin part 102 and the second pin part 103 are guided to move along the sliding groove 104 and thus the first slider 94 is supported on the first guide 92 such that the first slider 94 is able to ascend or descend along the vertical direction.

Figure 12:
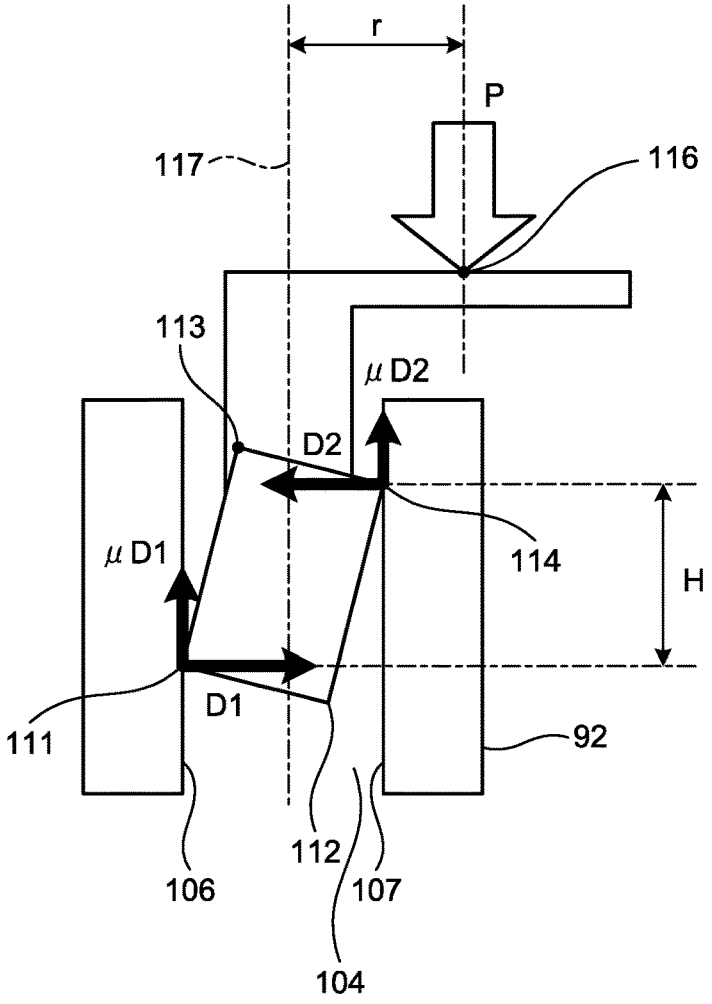
FIG. 12 is a schematic diagram of a model of the first guide and the first slider.

FIG. 12 is a schematic diagram of models of the first guide 92 and the first slider 94. In the first slider 94, as illustrated in FIG. 12, a force is applied to a point of effort 116. The point of effort 116 is arranged in a position apparat from a plane 117 by a given distance r. The plane 117 contains the rotation axis 52 and the rotation axis 53. The force is parallel with the plane 117 and pushes the point of effort 116 in a direction orthogonal to the rotation axis 53. In the first slider 94, the force is applied to the point of effort 116 and accordingly the first contact point 111 contacts the first sliding surface 106 of the first guide 92 and the fourth contact point 114 contacts the second sliding surface 107 of the first guide 92.

The magnitude of force to cause the pinch shaft 96 to rotate is expressed using a force P, a distance r, a distance H, a force D1, and a force D2 by the following Equation:

$$Pr=D1\times H=D2\times H \tag{1}$$

where the force P represents the magnitude of force applied to the point of effort 116, the force D1 represents the magnitude of normal force applied to the first contact point 111 from the first sliding surface 106, the force D2 represents the magnitude of normal force that is applied to the fourth contact point 114 from the second sliding surface 107, and the distance H represents the distance in the vertical direction from the first contact point 111 to the fourth contact point 114, in other words, represents the distance between two points obtained by normally projecting the first contact point 111 and the fourth contact point 114 onto the straight line parallel with the vertical direction. The distance H is larger than the diameter of the pinch shaft 96. Equation (1) above represents that the force D1 and the force D2 decrease as the distance H increases.

The force of friction applied to the first slider 94 when the pinch shaft 96 moves in the vertical direction is expressed using a coefficient of friction μ by the following Equation:

$$\mu(D1+D2)=2\mu Pr/H \tag{2}$$

representing that, as the distance H increases, the force of friction applied to the first slider 94 when the pinch shaft 96 moves vertically decreases.

The distance H is larger than the diameter of the pinch shaft 96 and thus it is possible to reduce the degree of trouble more than with another slider in which the distance H is smaller than the diameter of the pinch shaft 96. In the first slider 94, the reduction of degree of trouble enables reduction of degree of trouble in the pinch shaft 96. The degree of trouble in the pinch shaft 96 is reduced and thus the thickness sensor 97 is able to measure result, it is possible to measure the thickness of the original conveyed on the conveyance path 65 accurately.

The first slider 94 is formed further such that the distance between two points obtained by normal projection of the second contact point 112 and the third contact point 113 onto a straight line parallel with the vertical direction is equal to the distance H. In the first slider 94, when a force in a direction opposite to that in FIG. 12 is applied to the point of effort 116, the second contact point 112 contacts the second sliding surface 107 and the third contact point 113 contacts the first sliding surface 106 of the first guide 92 in the first slider 94, even when the force in a direction opposite to that in FIG. 12 is applied to the point of effort 116, as the distance H increases, the force of friction applied to the first slider 94 when the pinch shaft 96 moves in the vertical direction decreases.

The second guide 93 is formed similarly to the first guide 92. The second slider 95 is formed similarly to the first slider 94. For this reason, the second slider 95 is supported on the second guide 93 such that the second slider 95 is able to ascend and descend along the vertical direction. The first slider 94 is supported on the first guide 92 such that the first slider 94 is able to ascend and descend and the second slider 95 is supported on the second guide 93 such that the second slider 95 is able to ascend and descend and thus the pinch shaft 96 is supported on the frame 20 such that the pinch shaft 96 is able to ascend and descend along the vertical direction. In the second slider 95, as in the first slider 94, as the distance H increases, the force of friction applied to the second slider 95 when the pinch shaft 96 moves in the vertical direction decreases.

Figure 13:
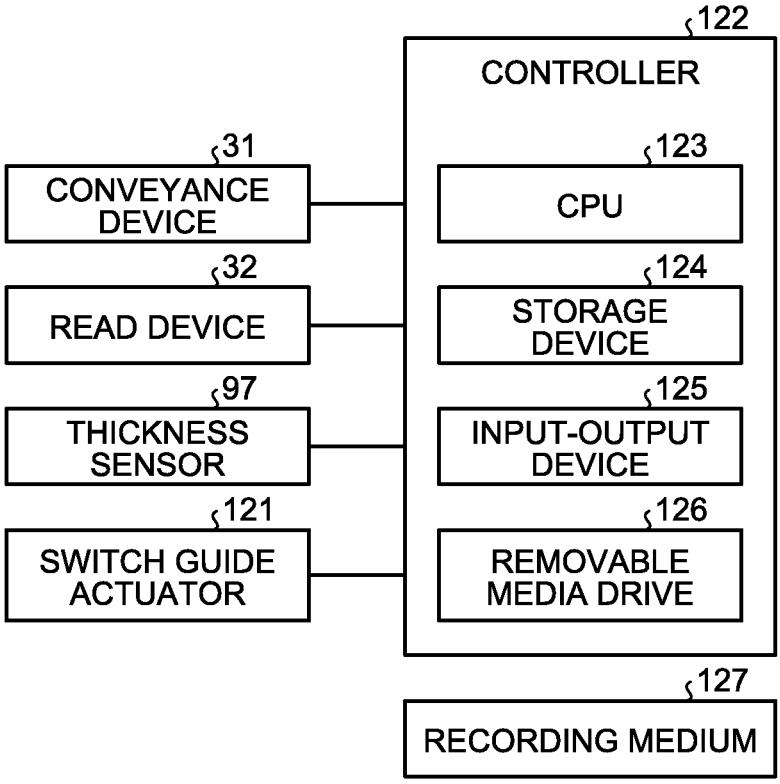
FIG. 13 is a block diagram of the medium conveyance device of the first embodiment.

FIG. 13 is a block diagram of the medium conveyance device 1 of the first embodiment. As illustrated in FIG. 13, the medium conveyance device 1 further includes a switch guide actuator 121 and a controller 122. The switch guide actuator 121 is controlled by the controller 122 and accordingly causes the switch guide 38 to be arranged in a return path guide position or a straight path guide position.

The controller 122 is a computer and includes a central processing unit (CPU) 123, a storage device 124, an input-output device 125, and a removable media drive 126. The CPU 123 executes a computer program that is installed in the controller 122 to perform information processing and control the storage device 124, the input-output device 125, and the removable media drive 126. The CPU 123 executes the computer program to further control the conveyance device 31, the read device 32, the thickness sensor 97, and the switch guide actuator 121. The storage device 124 records the computer program and records information that is used by the CPU 123. The storage device 124 is able to use, for example, any one, some, or all of a memory, such as a RAM or a ROM, a fixed disk device, such as a hard disk, a solid state drive (SSD) and an optical disk. The input-output device 125 is, for example, a touch panel and outputs information that is generated by operation by the user on the touch panel to the CPU 123 and outputs information that is generated by the CPU 123 such that the information is recognizable by the user. The removable media drive 126 is formed such that a non-transitory and tangible recording medium 127 is mountable. A memory card, a USB memory, a SD card, a flexible disk, a magneto-optical disc, a ROM, a EPROM, a EEPROM, a CD-ROM, a MO, a DVD, a blu-ray (trademark) disc, etc., are exemplified as the recording medium 127. When the recording medium 127 is mounted on the removable media drive 126, the removable media drive 126 is controlled by the CPU 123 and accordingly reads the information stored in the recording medium 127. The computer program that is installed in the controller 122 may be one that is read from the recording medium 127 via the removable media drive 126.

The controller 122 controls the conveyance device 31 such that the originals placed on the shooter 3 are conveyed to the conveyance path 65, the conveyance path 66, the return conveyance path 67, and the straight conveyance path 68. Specifically, the controller 122 controls the conveyance motor of the conveyance device 31 such that one of the originals placed on the shooter that is arranged at the top is conveyed to the conveyance path 65. The controller 122 controls the conveyance motor of the conveyance device 31 such that the first drive roller 42 is caused to rotate normally and accordingly the original conveyed on the conveyance path 65 is conveyed between the lower image sensor 61 and the upper image sensor 62. The controller 122 controls the conveyance motor of the conveyance device 31 such that the second drive roller 44 is caused to rotate normally and accordingly the original conveyed between the lower image sensor 61 and the upper image sensor 62 is conveyed to the return conveyance path 67 or the straight conveyance path 68. The controller 122 controls the conveyance motor of the conveyance device 31 such that the third drive roller 46 is caused to rotate normally and the original conveyed on the return conveyance path 67 is placed on the stacker 6.

The controller 122 controls the read device 32 such that the image on the original conveyed by the conveyance device 31 is read. The controller 122 further records the image of the read original in the storage device 124. The controller 122 further performs image processing on the read image of the original and records the image on which the image processing has been performed in the storage device 124.

The controller 122 controls the thickness sensor 97 such that the thickness of the original conveyed on the conveyance path 65 is measured. Based on the thickness of the original that is measured by the thickness sensor 97, the controller 122 controls the switch guide actuator 121 such that the switch guide 38 is arranged in any one of the return path guide position and the straight path guide position. In other words, the controller 122 controls the switch guide actuator 121 such that, when the thickness of the original that is measured by the thickness sensor 97 is under a given threshold, the switch guide 38 is arranged in the return path guide position. The controller 122 controls the switch guide actuator 121 such that, when the thickness of the original measured by the thickness sensor 97 is above the threshold, the switch guide 38 is arranged in the straight path guide position.

The CPU 123 may be configured of another tangible controller that overall controls the controller 122. A digital signal processor (DSP), a large scale integration (LSI), an application specific integrated circuit (ASIC), or a field-programmable gate array (FPGA) is exemplified as the tangible controller.

Operations of Conveyance Device 1 of First Embodiment.

To read an image of an original with the medium conveyance device 1, first of all, a user moves the first shooter member 25 to the shooter development position such that the shooter 3 is developed. When the first shooter member 25 moves to the shooter development position, the interlock mechanism of the shooter 3 causes the shooter 3 to extend. In other words, when the first shooter member 25 moves to the shooter development position, the interlock mechanism of the shooter 3 causes the second shooter member 26 to move to the extension position. When the second shooter member 26 moves to the extension position, the interlock mechanism of the shooter 3 causes the third shooter member 27 to move to the extension position. After the shooter 3 develops and extends, the user places originals on the shooter placement surface 11. After placing the originals on the shooter placement surface 11, the user operates the medium conveyance device 1 such that, the images on the originals placed on the shooter 3 are read by the medium conveyance device 1.

When the user operates the medium conveyance device 1, the controller 122 controls the conveyance motor of the conveyance device 31, thereby causing the pick roller 41, the first drive roller 42, the second drive roller 44, and the third drive roller 46 to rotate normally. When the pick rocker 41, the first drive roller 42, the second drive roller 44, and the third drive roller 46 rotate normally, the stacker 6 develops and extends. The pick rocker 41 rotates normally and accordingly the conveyance device 31 conveys the originals that are placed on the shooter placement surface 11 one by one from the shooter placement surface 11 to the conveyance path 65.

The original conveyed to the conveyance path 65 contacts the first pinch roller 43 and pushes the first pinch roller 43 up by a force by which the original is conveyed. The original pushes the first pinch roller 43 up and accordingly the pinch shaft 96 of the first pinch roller 43 ascends by the thickness of the original. The pinch shaft 96 ascends by the thickness of the original and accordingly the first slider 94 and the second slider 95 ascends by the thickness of the original. The pinch shaft 96 is supported by the first guide 92, the second guide 93, the first slider 94, and the second slider 95 and thus the pinch shaft 96 is prevented from rotating.

When the first pinch roller 43 contacts the original, the force to convey the original causes the first pinch roller 43 to rotate and the elastic force of the spring 99 causes the first pinch roller 43 to push the original against the first drive roller 42. The first drive roller 42 rotates normally and accordingly the original that is pushed against the first drive roller 42 is conveyed on the conveyance path 65. The original that is conveyed on the conveyance path 65 is supplied to the read device 32. The original that is conveyed on the conveyance path 65 is guided and accordingly is between the lower image sensor 61 and the upper image sensor 62 and then is supplied to the conveyance path 66. The original supplied to the conveyance path 66 is then pushed by the second pinch roller 45 against the second drive roller 44 and is conveyed on the conveyance path 66 because the second drive roller 44 rotates normally.

In the read device 32, when the original is conveyed between the conveyance path 65 and the conveyance path 66, the lower image sensor 61 contacts the lower read surface of the original and reads the image on the lower read surface and the upper image sensor 62 contacts the upper read surface of the original and reads the image on upper the read surface.

When the original is conveyed on the conveyance path 65, the controller 122 controls the thickness sensor 97 to measure an amount of ascending of the pinch shaft 96 of the first pinch roller 43 or the first slider 94, thereby measuring the thickness of the original. The pinch shaft 96 is prevented to rotate and thus the thickness sensor 97 is able to measure the thickness of the original relatively accurately.

When the thickness of the original is under the given threshold, the controller 122 controls the switch guide actuator 121, thereby arranging the switch guide 38 in the return path guide position. When the thickness of the original is above the given threshold, the controller 122 controls the switch guide actuator 121, thereby arranging the switch guide 38 in the straight path guide position. When arranged in the return path guide position, the switch guide 38 guides the original conveyed on the conveyance path 66 to the return conveyance path 67. The original guided to the return conveyance path 67 is pushed by the third pinch roller 47 against the third drive roller 46, is conveyed on the return conveyance path 67 because the third drive roller 46 rotates normally, and then is placed on the stacker placement surface 15 of the stacker 6. When arranged in the straight path guide position, the switch guide 38 guides the original conveyed on the conveyance path 66 to the straight conveyance path 68. The conveyance device 31 ejects the original guided to the straight conveyance path 68 to the outside of the casing 2.

When all the originals placed on the shooter 3 are elected, the controller 122 controls the conveyance motor of the conveyance device 31, thereby causing the pick roller 41, the first drive roller 42, the second drive roller 44, and the third drive roller 46 to rotate inversely. The pick roller 41, the first drive roller 42, the second drive roller 44, and the third drive roller 46 rotate inversely and accordingly the stacker 6 contracts and then is stored in the stacker storage area 18.

Paper is exemplified as an original whose thickness is under the given threshold. The original has flexibility and thus tends not to have curvature even when conveyed on the return conveyance path 67 and paper jamming tends not to occur on the return conveyance path 67. Heavy paper and plastic cards, such as a credit card, are exemplified as an original whose thickness is above the given threshold. Such an original tends to have curvature when conveyed on the return conveyance path 67 or paper jamming tends to occur on the return conveyance path 67. Because of such tendency, in the medium conveyance device 1, ejection of a thick original via the straight conveyance path 68 without conveyance of the original on the return conveyance path 67 tends not to cause curvature in the original and tends not cause paper jamming on the return conveyance path 67.

Medium Conveyance Device of Comparative Example 1

Figure 14:
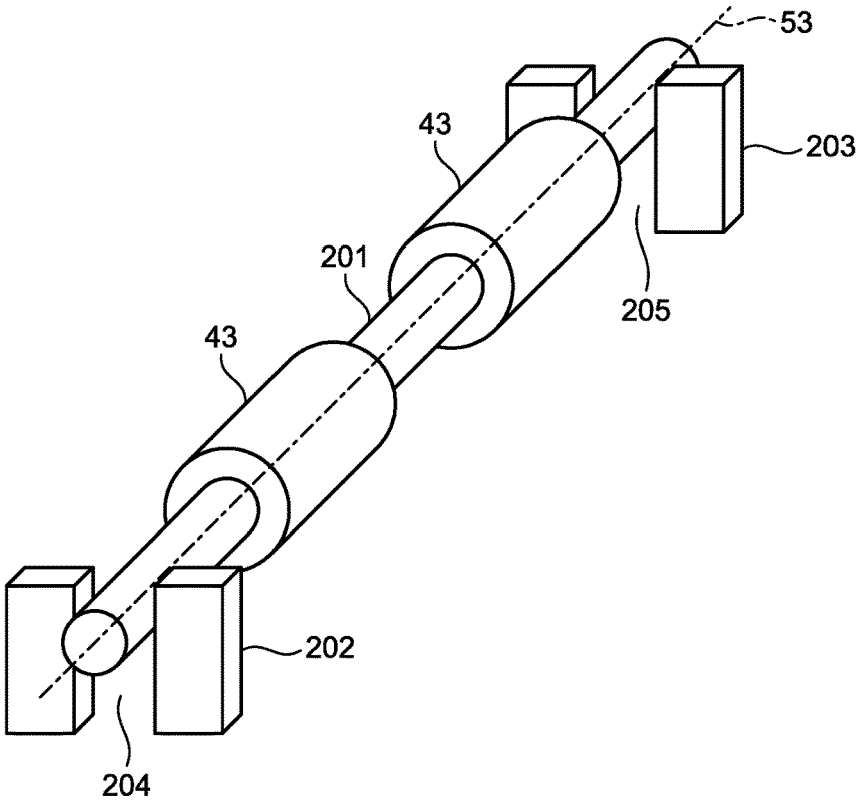
FIG. 14 is a perspective view of a pinch shaft, a first guide, and a second guide of a medium conveyance device of Comparative Example 1.

FIG. 14 is a perspective view of a pinch shaft 201, a first guide 202, and a second guide 203 of a medium conveyance device of Comparative Example 1. As illustrated in FIG. 14, the medium conveyance device of Comparative Example 1 is obtained by replacing the pinch shaft 96 of the medium conveyance device 1 of the above-described first embodiment with another pinch shaft that is the pinch shaft 201 and replacing the first guide 92 and the second guide 93 with other guides that are the first guide 202 and the second guide 203. The pinch shaft 201 is formed into a cylindrical shape. The first guide 202 is fixed to the frame 20, and a sliding groove 204 is formed in the first guide 202. The sliding groove 204 is formed along the vertical direction. The second guide 203 is fixed to the frame 20 and a sliding groove 205 is formed in the second guide 203. The sliding groove 205 is formed along the vertical direction. Part of the pinch shaft 201 is fitted in the sliding groove 204 of the first guide 202 and other part of the pinch shaft 201 is fitted in the sliding groove 205 of the second guide 203. The first pinch roller 43 is fixed to the pinch shaft 201.

The pinch shaft 201 is fitted in the sliding groove 204 and the sliding groove 205 and thus is supported on the first guide 202 and the second guide 203 rotatably about the rotation axis 53 and movably vertically. The first pinch roller 43 is fixed to the pinch shaft 201 and thus is supported on the frame 20 rotatably about the rotation axis 53 and movably vertically.

The movable part of the thickness sensor 97 slides on the pinch shaft 201 when the pinch shaft 201 rotates. The movable part of the thickness sensor 97 may be worn because the movable part slides on the pinch shaft 201. Wear of the movable part may lower the accuracy at which the thickness sensor 97 measures the position of the pinch shaft 201. In the medium conveyance device 1 of the above-described first embodiment, the pinch shaft 96 is supported such that the pinch shaft 96 is able to ascend and descend without turning and thus it is possible to measure the position of the pinch shaft 96 more accurately than with the medium conveyance device of Comparative Example 1. In the medium conveyance device 1 of the first embodiment, the position of the pinch shaft 96 is measured accurately and thus it is possible to accurately measure the thickness of the original conveyed on the conveyance path 65. In the medium conveyance device 1 of the first embodiment, the thickness of the original conveyed on the conveyance path 65 is measured accurately and and thus it is possible to appropriately switch between ejecting the original via the return conveyance path 67 and ejecting the original via the straight conveyance path 68.

Medium Conveyance Device of Comparative Example 2

Figure 15:
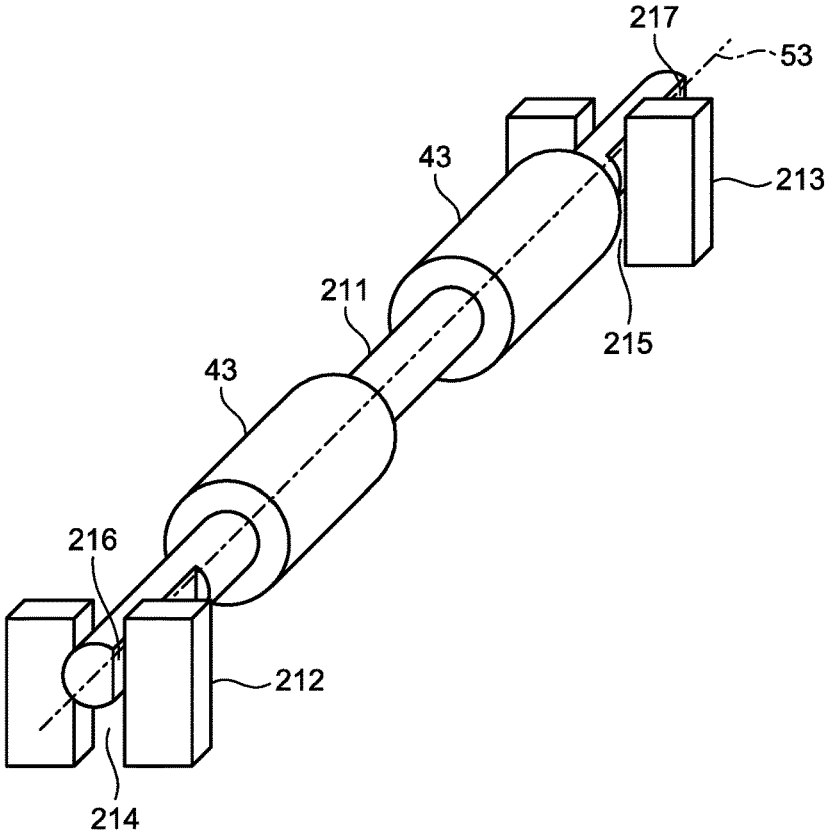
FIG. 15 is a perspective view of a pinch shaft, a first guide, and a second guide of a medium conveyance device of Comparative Example 2.

FIG. 15 is a perspective view of a pinch shaft 211, a first guide 212, and a second guide 213 of a medium conveyance device of Comparative Example 2. As illustrated in FIG. 15, the medium conveyance device of Comparative Example 2 is obtained by replacing the pinch shaft 96 of the medium conveyance device 1 of the above-described first embodiment with another pinch shaft that is the pinch shaft 211 and replacing the first guide 92 and the second guide 93 with other guides that are the first guide 212 and the second guide 213. The pinch shaft 211 is formed into an approximately cylindrical shape. The pinch shaft 211 is slidably inserted into the through hole that is formed in the first pinch roller 43 and thus the first pinch roller 43 is supported on the pinch shaft 211 rotatably about the rotation axis 53.

The first guide 212 is fixed to the frame 20 and a sliding groove 214 is formed in the first guide 212. The sliding groove 214 is formed along the vertical direction. The second guide 213 is fixed to the frame 20 and a sliding groove 215 is formed in the second guide 213. The sliding groove 215 is formed along the vertical direction. In the pinch shaft 211, a first D cut surface 216 and a second D cut surface 217 are formed. Each of the first D cut surface 216 and the second D cut surface 217 is formed flat. In the pinch shaft 211, the part of the pinch shaft 211 where the first D cut surface 216 is formed is fitted in the sliding groove 214. In the pinch shaft 211, the part of the pinch shaft 211 where the second D cut surface 217 is formed is fitted in the sliding groove 215.

Figure 16:
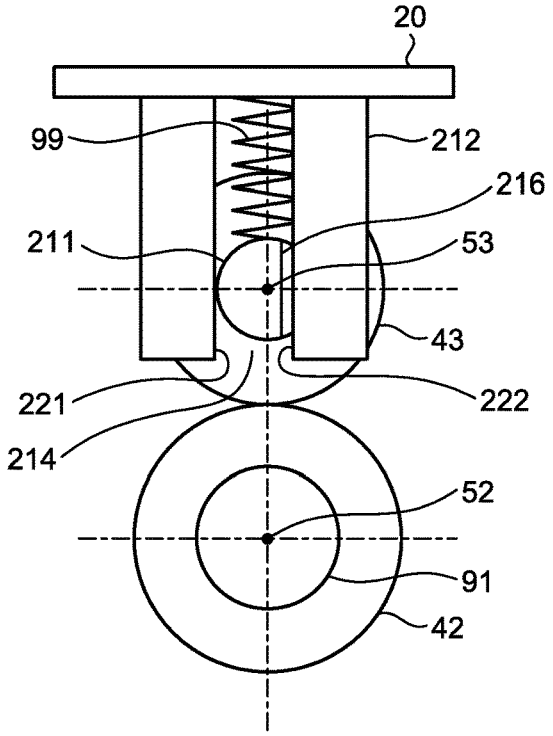
FIG. 16 is a side view of a pinch shaft and a first guide of the medium conveyance device of Comparative Example 2.

FIG. 16 is a side view of the pinch shaft 211 and the first guide 212 of the medium conveyance device of Comparative Example 2. In the sliding groove 214 of the first guide 212, as illustrated in FIG. 16, a first sliding surface 221 and a second sliding surface 222 are formed. The first sliding surface 221 is an end surface that forms the sliding groove 214 and is formed flat. The second sliding surface 222 is another end surface that forms the sliding groove 214, is formed flat, and is opposed to the first sliding surface 221. In the pinch shaft 211, the part of the pinch shaft 211 where the first D cut surface 216 is formed is fitted in the sliding groove 214 such t the first D cut surface 216 is opposed to the second sliding surface 222.

Figure 17:
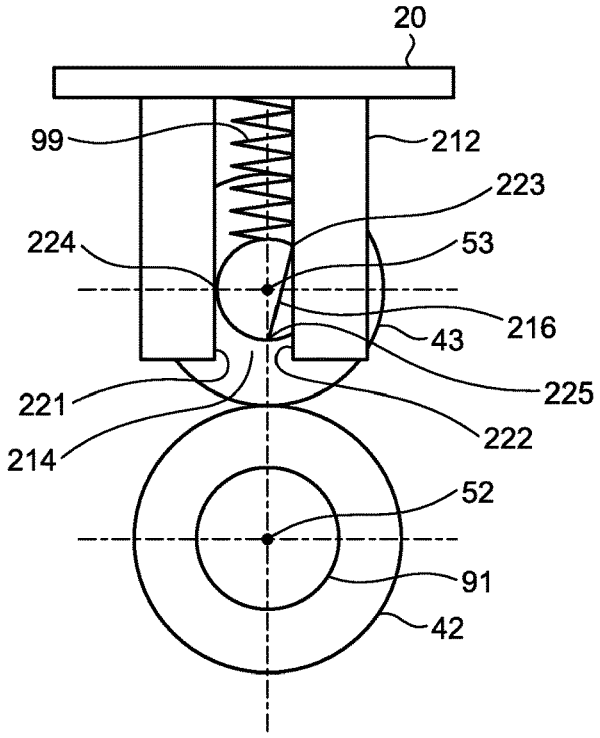
FIG. 17 is a side view of the pinch shaft and the first guide of the medium conveyance device of Comparative Example 2 in the case where a force for rotation is applied to the pinch shaft.

FIG. 17 is a side view of the pinch shaft 211 and the first guide 212 of the medium conveyance device of Comparative Example 2 in the case where a force for rotation is applied to the pinch shaft 211. In the pinch shaft 211, when a force for rotation is applied to the pinch shaft 211, as illustrated in FIG. 17, a D cut surface side contact point 223 contacts the second sliding surface 222 and a curve surface side contact point 224 contacts the first sliding surface 221. The D cut surface side contact point 223 is formed in an upper end of the first D cut surface. The curve surface side contact point 224 is formed in part of the curve surface of the pinch shaft 211 where the first D cut surface 216 is not formed. The D cut surface side contact point 223 contacts the second sliding surface 222 and the curve surface side contact point 224 contacts the first sliding surface 221 and thus the pinch shaft 211 is prevented from rotating.

In the pinch shaft 211, when the force for rotation in a direction opposite to that of the above-described case is applied to the pinch shaft. 211, a D cut surface side contact point 225 in a lower end of the first D cut surface 216 contacts the second sliding surface 222 and the curve surface side contact point 224 contacts the first sliding surface 221. The D cut surface side contact point 225 contacts the second sliding surface 222 and the curve surface side contact point 224 contacts the first sliding surface 221 and this prevents the pinch shaft 211 from rotating.

The distance between the D cut surface side contact point 223 and the curve surface side contact point 224 in the vertical direction is shorter than the diameter of the pinch shaft 211 because the D cut surface side contact point 223 and the curve surface side contact point 224 are formed in the pinch shaft 211. The distance between the D cut surface side contact point 225 and the curve surface side contact point 224 in the vertical direction is shorter than the diameter of the pinch shaft 211 because the D cut surface side contact point 225 and the curve surface side contact point 224 are formed in the pinch shaft 211. In the pinch shaft 211, the distance between the D cut surface side contact point 223 (225) and the curve surface side contact point 224 in the vertical direction is shorter than the diameter of the pinch shaft 211 and thus the magnitude of normal force that is applied to the pinch shaft 211 from the first sliding surface 221 and the second sliding surface 222 is relatively large. In the pinch shaft 211, the magnitude of the normal force that is applied to the pinch shaft 211 from the first sliding surface 221 and the second sliding surface 222 is large and thus the force of friction applied when the pinch shaft 211 moves vertically is relatively large.

The force of friction applied to the pinch shaft 96 of the medium conveyance device 1 of the above-described first embodiment is smaller than the force of friction applied to the pinch shaft 211 of the medium conveyance device of Comparative Example 2 because the distance between the first contact point 11 and the fourth contact point 114 is larger than the diameter of the pinch shaft 96. The pinch shaft 96 of the medium conveyance device 1 of the first embodiment is able to ascend appropriately by the thickness of the original when the original contacts the first pinch roller 43 because the force of friction applied to the pinch shaft 96 is small. The thickness sensor 97 is able to measure the thickness of the original that is conveyed on the conveyance path 65 more accurately than in the medium conveyance device of Comparative Example 1. In the medium conveyance device 1 of the above-described first embodiment, by measuring the thickness of the original conveyed on the conveyance path 65, it is possible to appropriately switch between ejecting the original via the return conveyance path 67 and ejecting the original via the straight conveyance path 68.

Figure 18:
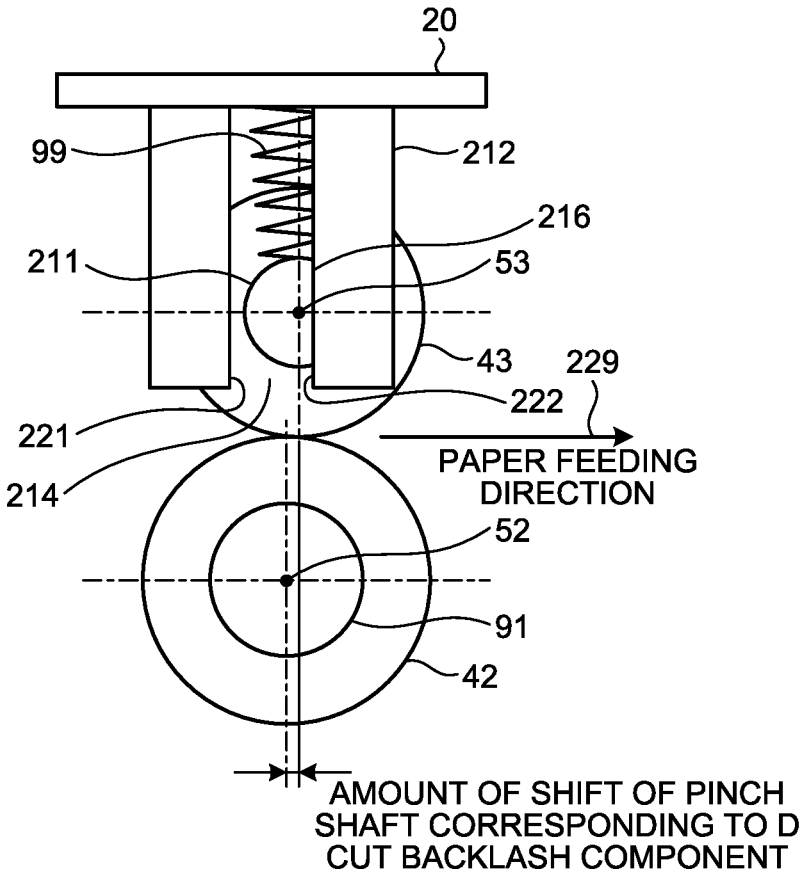
FIG. 18 is a side view of the pinch shaft and the first guide of the medium conveyance device of Comparative Example 2 in the case where the pinch shaft moves in a paper-feeding direction.

FIG. 18 is a side view of the pinch shaft 211 and the first guide 212 of the medium conveyance device of Comparative Example 2 in the case where the pinch shaft 211 moves in a paper-feeding direction. A clearance is formed between the pinch shaft 211 and the sliding groove 214 and accordingly, as illustrated in FIG. 18, the pinch shaft 211 may move in a paper feeding direction 229 such that the first D cut surface 216 may adhere to the second sliding surface 222. When the first D cut surface 216 of the pinch shaft 211 adheres to the second sliding surface 222, the rotation axis 53 of the first pinch roller 43 moves in the paper feeding direction 229 with respect to the rotation axis 52 of the first drive roller 42 and thus ascending and descending of the first pinch roller 43 tends to be unstable.

In the medium conveyance device 1 of the first embodiment, by supporting the pinch shaft 96 such that the pinch shaft 96 is able to ascend and descend via the first slider 94, it is possible to cause the pinch shaft 96 to ascend and descend stably more than in the medium conveyance device of Comparative Example 2. In the medium conveyance device 1 of the first embodiment, the pinch shaft 96 is caused to ascend and descend stably and thus it is possible to measure the thickness of the original accurately with the thickness sensor 97.

Effect of Medium Conveyance Device 1 of First Embodiment

The medium conveyance device of the device 1 first embodiment includes the first drive roller 42, the first guide 92, the first slider 94, the first pinch roller 43, and the thickness sensor 97. The first drive roller 42 rotates and accordingly conveys an original. In the first guide 92, the first sliding surface 106 and the second sliding surface 107 are formed. In the first slider 94, the first contact point 111 and the fourth contact point 114 are formed. The first contact point 111 slides on the first sliding surface 106 and the fourth contact point 114 slides on the second sliding surface 107 and thus the first slider 94 is supported on the first guide 92 movably in the vertical direction. The first pinch roller 43 is supported on the first slider 94 rotatably via the pinch shaft 96 and pushes the original against the first drive roller 42. The thickness sensor 97 measures the thickness of the original based on the amount of move of the first slider 94 in the vertical direction that is different from the conveyance direction in which the original is conveyed. The distance between the first contact point 111 and the fourth contact point 114 in the vertical direction is longer than the diameter of the pinch shaft 96.

In the medium conveyance device 1, the distance between the first contact point 111 and the fourth contact point 114 in the vertical direction is large and thus it is possible to reduce trouble in the pinch shaft 96 more than in another device that supports the D-cut pinch shaft 96 movably. In the medium conveyance device, trouble in the first slider 94 is reduced and thus the thickness sensor 97 is able to measure the thickness of the original accurately.

In the medium conveyance device 1 of the first embodiment, the pinch shaft 96 is fixed to the first slider 94. The thickness sensor 97 measures the thickness of the original based on the amount of move of the pinch shaft 96.

In the medium conveyance device 1, the pinch shaft 96 is fixed to the first slider 94 and thus it is possible to reduce trouble in the pinch shaft 96. In the medium conveyance device 1, trouble in the pinch shaft 96 is reduced and thus the thickness sensor 97 is able to accurately measure the thickness of the original based on the amount of move of the pinch shaft 96.

The movable part of the thickness sensor 97 of the medium conveyance device 1 of the first embodiment contacts the pinch shaft 96. Alternatively, the movable part may contact the first slider 94 without contacting the pinch shaft 96. In the medium conveyance device 1, even when the thickness sensor 97 measures the thickness of the original based on the amount of move of the first slider 94, trouble in the first slider 94 is reduced and thus the thickness sensor 97 is able to measure the thickness of the original accurately. The pinch shaft 96 of the medium conveyance device 1 of the first embodiment is fixed to the first slider 94. Alternatively, when the movable part of the thickness sensor 97 contacts the first slider 94 without contacting the pinch shaft 96, the pinch shaft 96 may be supported on the first slider 94 rotatably. Even when the pinch shaft 96 is supported on the first slider 94 rotatably, trouble in the first slider 94 is reduced and thus the thickness sensor 97 is able to measure the thickness of the original accurately.

The medium conveyance device 1 of the first, embodiment further includes the switch guide 38, the switch guide actuator 121, and the controller 122. The switch guide 38 is arranged in the return path guide position and thus guides the original to the return conveyance path 67, and the switch guide 38 is arranged in the straight path guide position and thus guides the original to the straight conveyance path 68. The switch guide actuator 121 causes the switch guide 38 to move. The controller 122 controls the switch guide actuator 121 based on the thickness of the original that is measured by the thickness sensor 97 such that the switch guide 38 is arranged in the return path guide position or the straight path guide position.

In the medium conveyance device 1, the thickness sensor 97 accurately measures the thickness of the original and and thus it is possible to guide the original to the return conveyance path 67 or the straight conveyance path 68 based on the thickness of the original.

In the first slider 94 of the medium conveyance device 1 of the first embodiment, the first pin part 102 and the second pin part 103 are provided separately. Alternatively, single part where the first contact point 111, the second contact point 112, the third contact point 113, and the fourth contact point 114 are formed may be provided. A rectangular part is exemplified as the single part. In the medium conveyance device 1 of the first embodiment, even when the single part is provided in the first slider 94, forming the first slider 94 such that the distance H is larger than the diameter of the pinch shaft 96 makes it possible to reduce trouble in the first slider 94.

The medium conveyance device 1 of the first embodiment is formed such that the conveyance path 65 and the conveyance path 66 are along the plane parallel with the setting surface on which the medium conveyance device 1 is set. Alternatively, the medium conveyance device 1 may be formed such that the conveyance path 65 and the conveyance path 66 are along a plane oblique to the setting surface. For example, the conveyance path 65 and the conveyance path 66 may be along a plane oblique to the setting surface by 15 degrees such that the conveyance path 65 is arranged above the conveyance path 66. In this case, when the original is conveyed from the shooter 3 toward the conveyance path 65, the degree of curve of the original is moderate and thus the original tends not to have curvature and paper jamming tends not to occur between the shooter 3 and the conveyance path 65. In the medium conveyance device 1, also when the conveyance path 65 and the conveyance path 66 are oblique, the distance H is larger than the diameter of the pinch shaft 96 and thus it is possible to reduce trouble in the first slider 94.

Second Embodiment

Figure 19:
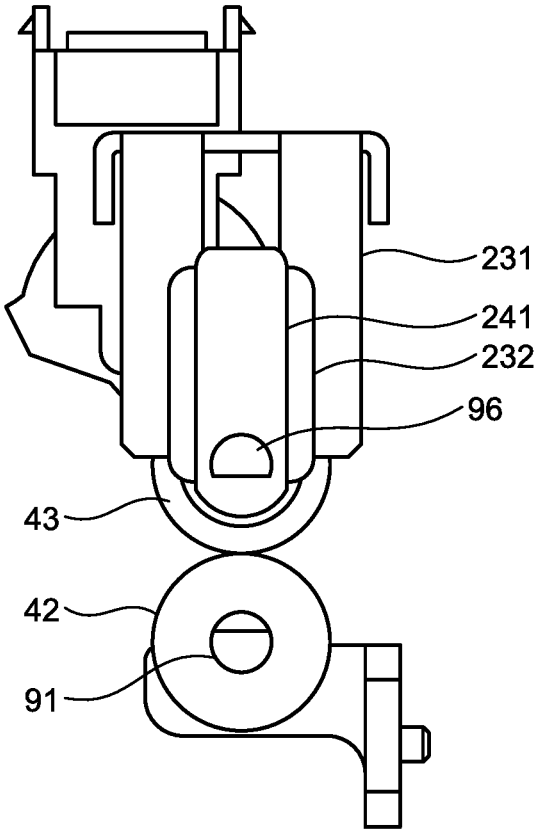
FIG. 19 is a side view of a guide and a slider of a medium conveyance device of a second embodiment.
Figure 20:
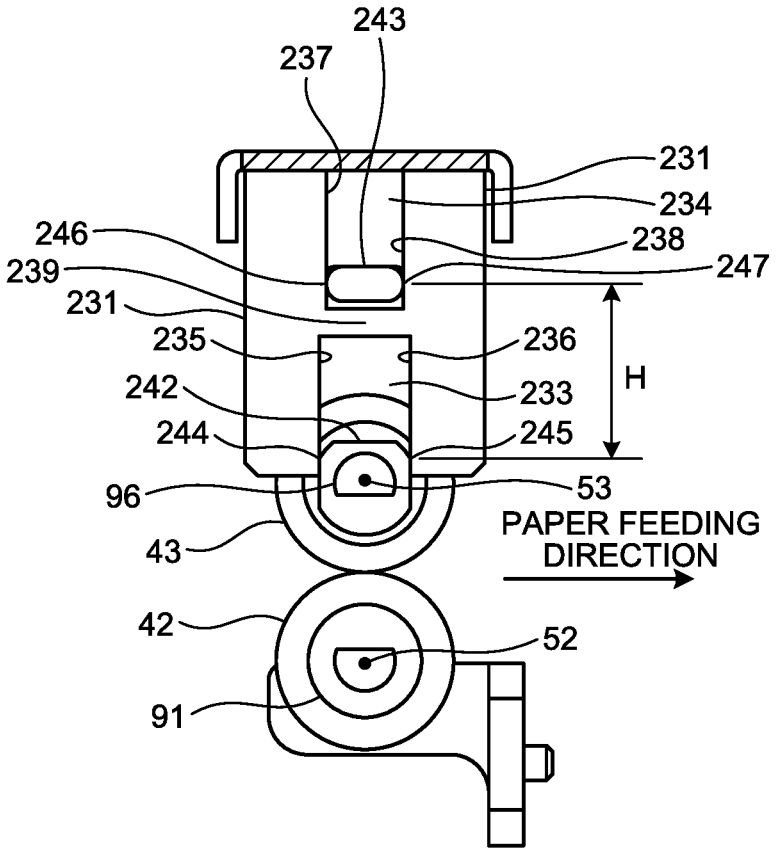
FIG. 20 is a side cross-sectional view of the guide and the slider of the medium conveyance device of the second embodiment.

FIG. 19 is a side view of a guide 231 and a slider 232 of a medium conveyance device of a second embodiment. FIG. 20 is a side cross-sectional view of the guide 231 and the slider 232 of the medium conveyance device of the second embodiment. As illustrated in FIG. 19, the medium conveyance device of the second embodiment is obtained by replacing the first guide 92 of the medium conveyance device 1 of the above-described first embodiment with another guide that is the guide 231 and replacing the first slider 94 with another slider that is the slider 232.

In the guide 231, as illustrated in FIG. 20, a first sliding groove 233 and a second sliding groove 234 are formed. The first sliding groove 233 is formed along a straight line that is parallel with the vertical direction. Furthermore, an end of the first sliding groove 233 on a side close to the first drive roller 42 is open. In the first sliding groove 233, a first sliding surface 235 and a second sliding surface 236 are formed. The first sliding surface 235 is an end surface that forms the first sliding groove 233 and is formed along a plane parallel with the vertical direction. The second sliding surface 236 is another end surface that forms the first sliding groove 233 and is formed such that the second sliding surface 236 is along the plane parallel with the vertical direction and is opposed to the first sliding surface 235.

The second sliding groove 234 is formed on a side where the second sliding groove 234 is more distant from the first drive roller 42 than the first sliding groove 233 is, and the second sliding groove 234 is formed along a straight line parallel with the vertical direction. In the second sliding groove 234, a third sliding surface 237 and a fourth sliding surface 238 are formed. The third sliding surface 237 is one end surface that forms the second sliding groove 234 and the third sliding surface 237 is formed along a plane that is parallel with the vertical direction. The fourth sliding surface 238 is another end surface that forms the second sliding groove 234 and the fourth sliding surface 238 is formed such that the fourth sliding surface 238 is along the plane parallel with the vertical direction and is opposed to the third sliding surface 237.

The guide 231 further includes a stopper 239. The stopper 239 is arranged between the first sliding groove 233 and the second sliding groove 234 and closest the end of the second sliding groove 234 on the side close to the first drive roller 42.

As illustrated in FIG. 19, the slider 232 includes a body part 241 and, as illustrated in FIG. 20, includes a first pin part 242 and a second pin part 243. The first pin part 242 is formed into a cylindrical shape and is fixed to the body part 241. Furthermore, the first pin part 242 is formed to surround part of the pinch shaft 96 and is fixed to the pinch shaft 96. The second pin part 243 is formed into a cylindrical shape as the first pin part 242 is. The second pin part 243 is arranged in a position distant from the first pin part 242 and is fixed to the body part 241.

The first pin part 242 is fitted in the first sliding groove 233. In the first pin part 242, a first contact point 244 and a second contact point 245 are formed. The first contact point 244 is formed in part of the first pin part 242, which is part opposed to the first sliding surface 235 when the first pin part 242 is fitted in the first sliding groove 233. The first contact point 244 is arranged above the rotation axis 53 of the first pinch roller 43. The second contact point 245 is formed in part of the first pin part 242, which is part opposed to the second sliding surface 236 when the first pin part 242 is fitted in the first sliding groove 233. The second contact point 245 is formed above the rotation axis 53 of the first pinch roller 43. The first pin part 242 is fitted in the first sliding groove 233 and thus the first contact point 244 may contact the first sliding surface 235 and the second contact point 245 may contact the second sliding surface 236.

The second pin part 243 is fitted in the second sliding groove 234. In the second pin part 243, a third contact point 246 and a fourth contact point 247 are formed. The third contact point 246 is formed in part of the second pin part 243, which is part opposed to the third sliding surface 237 when the second pin part 243 is fitted in the second sliding groove 234. The fourth contact point 247 is formed in part of the second pin part 243, which is part opposed to the fourth sliding surface 238 when the second pin part 243 is fitted in the second sliding groove 234. The second pin part 243 is fitted in the second sliding groove 234 and thus the third contact point 246 may contact the third sliding surface 237 and the fourth contact point 247 may contact the fourth sliding surface 238. The second pin part 243 is arranged such that the distance H between the first contact point 244 and the third contact point 246 in the vertical direction (or the distance between the second contact point 245 and the fourth contact point 247) is larger than the diameter of the pinch shaft 96 and the second pin part 243 is fixed to the body part 241.

The first pin part 242 is fitted in the first sliding groove 233 and the second pin part 243 is fitted in the second sliding groove 234 and thus the slider 232 is supported on the guide 231 such that the slider 232 is able to ascend and descend along the vertical direction.

The first pinch roller 43 contacts the first drive roller 42 when no original is conveyed on the conveyance path 65. Part of the first pin part 242 is arranged in the first sliding groove 233 such that, when the first pinch roller 43 contacts the first drive roller 42, the first contact point 244 is opposed to the first sliding surface 235 and the second contact point 245 is opposed to the second sliding surface 236. Other part of the first pin part 242 runs over the lower end of the first sliding groove 233 such that, when the first pinch roller 43 contacts the first drive roller 42, the rotation axis 53 of the first pinch roller 43 runs over the lower end of the first sliding groove 233. The second pin part 243 is arranged in the second sliding groove 234 such that the second pin part 243 does not contact the stopper 239 when the first pinch roller 43 contacts the first drive roller 42.

When no original is conveyed on the conveyance path 65, the first contact point 244 contacts the first sliding surface 235 and the fourth contact point 247 contacts the fourth sliding surface 238 and thus trouble in the slider 232 is prevented. Alternatively, when no original is conveyed on the conveyance path 65, the second contact point 245 contacts the second sliding surface 236 and the third contact point 246 contacts the third sliding surface 237 and thus trouble in the slider 232 is prevented. When no original is conveyed on the conveyance path 65, trouble in the slider 232 is prevented and thus trouble in the pinch shaft 96 is prevented.

Figure 21:
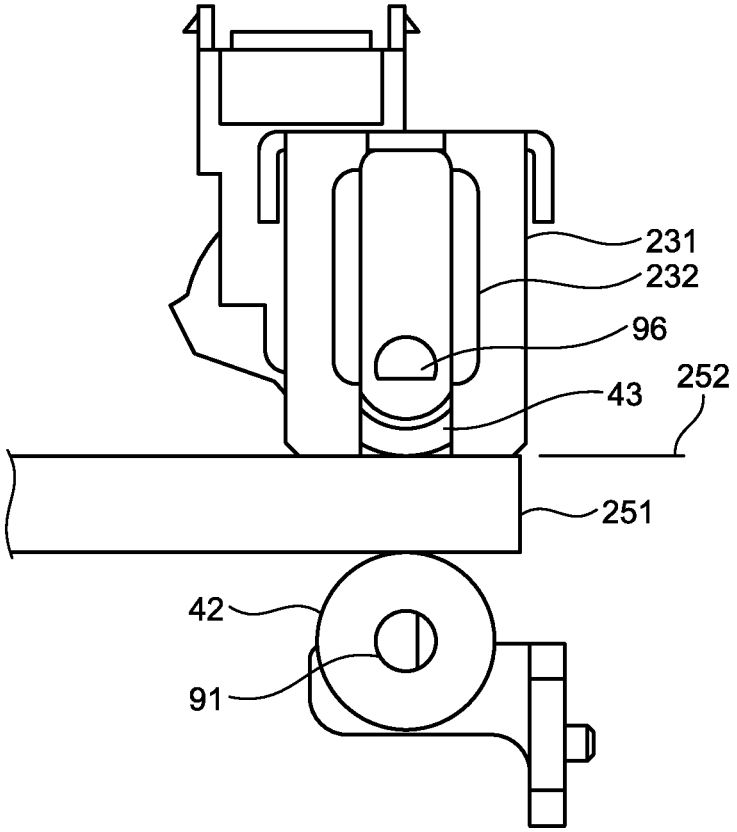
FIG. 21 is a side view of the guide and the slider of the medium conveyance device of the second embodiment in the case where a thick original is conveyed on a conveyance path.

FIG. 21 is a side view of the guide 231 and the slider 232 of the medium conveyance device of the second embodiment in the case where a thick original 251 is conveyed on the conveyance path 65. When the thick original 251 is conveyed on the conveyance path 65, the first pinch roller 43 is pushed up by the thick original 251 as illustrated FIG. 21. The thick original 251 is able to push up the first pinch roller 43 until the lower end of the first pinch roller 43 reaches a plane 252 along which the lower end of the guide 231 is. The thick original 251 pushes up the first pinch roller 43 and accordingly the slider 232 ascends.

On the other hand, in the first guide 92 of the medium conveyance device 1 of the above-described first embodiment, the lower end of the sliding groove 104 is closed and the lower end of the sliding groove 104 and the lower end of the first guide 92 separate from each other. In the guide 231, the lower end of the first sliding groove 233 is open and the lower end of the first sliding groove 233 and the lower end of the guide 231 match. The lower end of the first sliding groove 233 and the lower end of the guide 231 match and thus it is possible to separate the lower end of the guide 231 from the first drive roller 42 more than in the first guide 92 of the medium conveyance device 1 of the above-described first embodiment. For this reason, the medium conveyance device of the second embodiment is able to convey a thicker original on the conveyance path 65 than that in the medium conveyance device 1 of the first embodiment.

Figure 22:
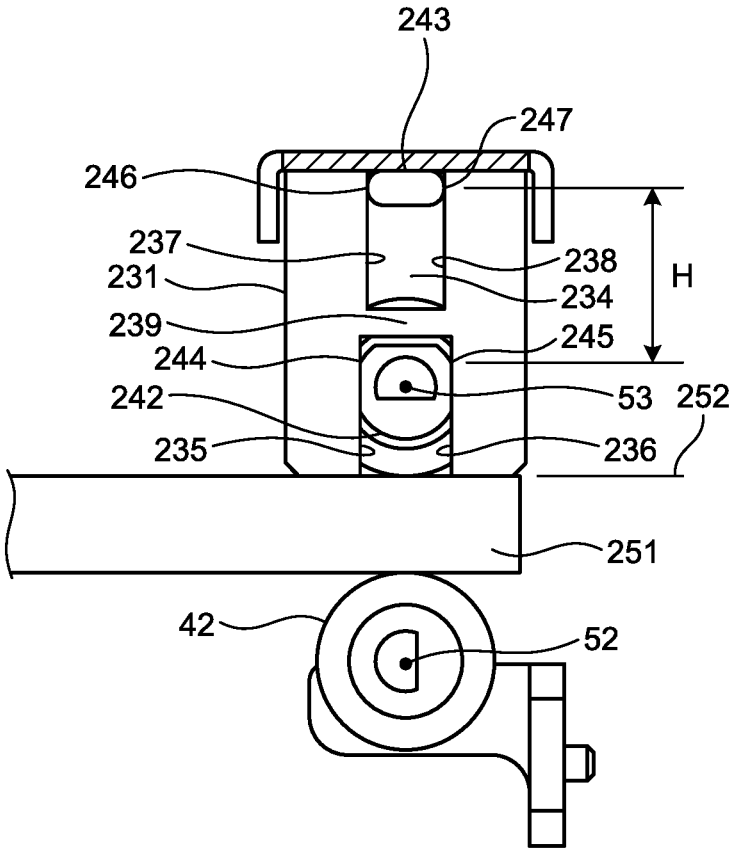
FIG. 22 is a side cross-sectional view of the guide and the slider of the medium conveyance device of the second embodiment in the case where the thick original is conveyed on the conveyance path.

FIG. 22 is a side cross-sectional view of the guide 231 and the slider 232 of the medium conveyance device of the second embodiment in the case where the thick original 251 is conveyed on the conveyance path 65. When the thick original 251 is conveyed on the conveyance path 65, as illustrated in FIG. 22, the whole first pin part 242 is arranged in the first sliding groove 233. The whole first pin part 242 as arranged in the first sliding groove 233 and thus the first contact point 244 is opposed to the first sliding surface 235. The whole first pin part 242 is arranged in the first sliding groove 233 and thus the second contact point 245 is opposed to the second sliding surface 236. The second pin part 243 is arranged in the second sliding groove 234 when the first pinch roller 43 contacts the first drive roller 42.

When the thick original 251 is conveyed on the conveyance path 65, the first contact point 244 contacts the first sliding surface 235 and the fourth contact point 247 contacts the fourth sliding surface 238 and thus trouble in the slider 232 is prevented. Alternatively, when the thick original 251 is conveyed on the conveyance path 65, the second contact point 245 contacts the second sliding surface 236 and the third contact point 246 contacts the third sliding surface 237 and thus trouble in the slider 232 is prevented. When the thick original 251 is conveyed on the conveyance path 65, trouble in the slider 232 is prevented and thus trouble in the pinch shaft 96 is prevented.

Figure 23:
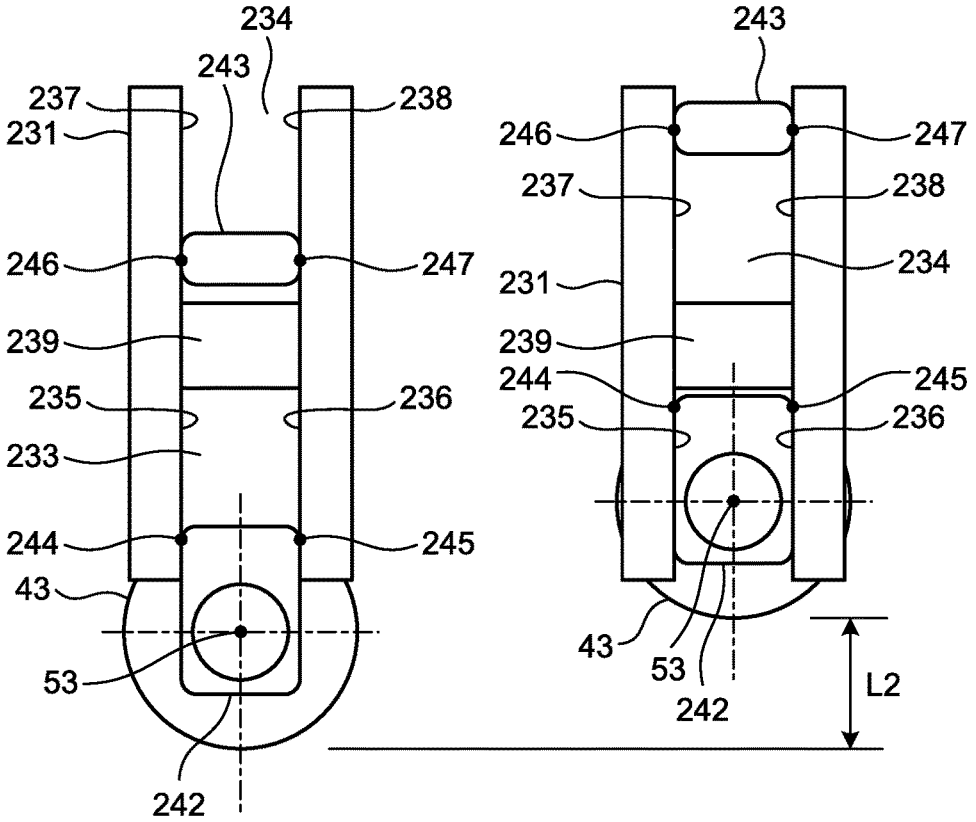
FIG. 23 is a schematic diagram illustrating an area in which a first pinch roller of the medium conveyance device of the second embodiment is movable.

FIG. 23 is a schematic diagram illustrating an area L2 in which the first pinch roller 43 of the medium conveyance device of the second embodiment is movable. The first contact point 244 and the second contact point 245 are formed above the rotation axis 53 of the first pinch roller 43 and thus the slider 232 is able to descend until the rotation axis 53 is arranged below the lower end of the guide 231. This enables the larger area L2 in which the first pinch roller 43 is movable to ascend and descend than the radius of the first pinch roller 43.

Figure 24:
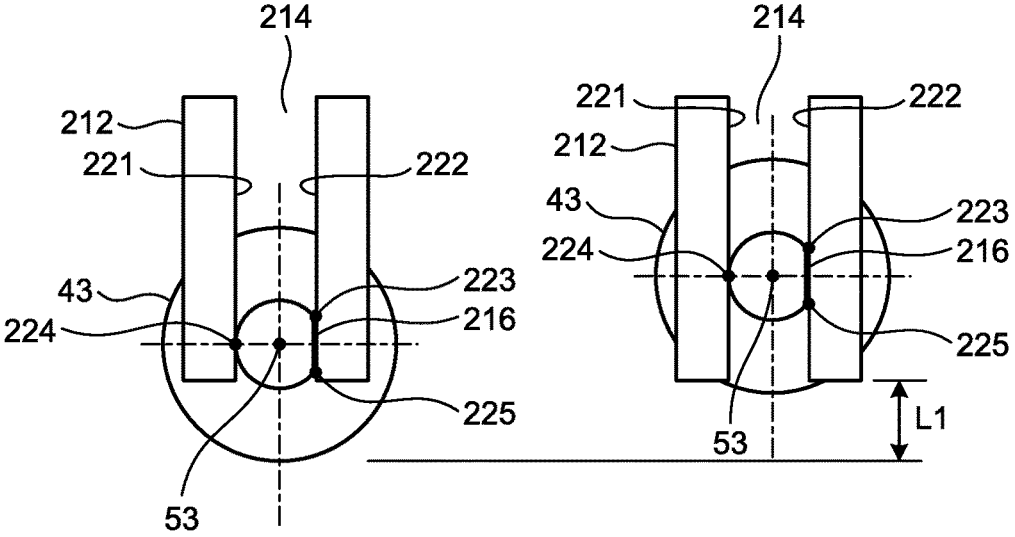
FIG. 24 is a schematic diagram illustrating an area in which the first pinch roller of the medium conveyance device of Comparative Example 2 is movable.

FIG. 24 a schematic diagram illustrating an area L1 in which the first pinch roller 43 of the medium conveyance device of Comparative Example 2 is movable. In the pinch shaft 211 of the medium conveyance device of Comparative Example 2 described above, as illustrated in FIG. 24, the D cut surface side contact point 225 is formed below the rotation axis 53 of the first pinch roller 43. For this reason, in the pinch shaft 211, the D cut surface side contact point 225 is able to descend only to the lower end of the second sliding surface 222 and the rotation axis 53 is unable to descent to be arranged below the lower end of the first guide 212. As a result, the area L1 in which the pinch shaft 211 is movable to ascend and descend cannot be larger than the radius of the first pinch roller 43 and cannot be larger than the area L2.

In other words, the first contact point 244 and the second contact point 245 are arranged above the rotation axis 53 and thus the area L2 in which the first pinch roller 43 of the medium conveyance device of the second embodiment is movable can be larger than the area L1 in which the first pinch roller 43 of the medium conveyance device of Comparative Example 2 is movable. In the medium conveyance device of the second embodiment, the area L2 is large than the area L2 and thus it is possible to convey an original that is thicker than that conveyed by the medium conveyance device of Comparative Example 2.

Effect of Medium Conveyance Device of Second Embodiment

The first pin part 242 is fitted in the first sliding groove 233 having the first sliding surface 235 and the second sliding surface 236 and thus the slider 232 of the medium conveyance device of the second embodiment is supported on the guide 231 movably in the vertical direction. The end of the first sliding groove 233 on the side of the first drive roller 42 is open.

In the medium conveyance device, the end of the first sliding groove 233 on the side of the first drive roller 42 is open and thus part of the first pin part 242 of the slider 232 movable such that part of the first pin part 242 runs over the first sliding groove 233. This enables, in the medium conveyance device, the larger area L2 in which the slider 232 is movable than that in another medium conveyance device in which the first pin part 242 does not run over the first sliding groove 233. In the medium conveyance device, the area L2 is large and thus, even when the original is thick, the first pinch roller 43 is able to properly push the thick original against the first drive roller 42 and thus it is possible to properly convey the thick original.

The slider 232 of the medium conveyance device of the second embodiment includes the first pin part 242 and the second pin part 243. In the first pin part 242, the first contact point 244 is formed. In the second pin part 243, the fourth contact point 247 is formed, and the second pin part 243 is arranged on a side more distant from the first drive roller 42 than the first pin part 242 is. The guide 231 includes the stopper 239 with which the second pin part 243 is engaged to prevent the second pin part 243 from moving from a given position to the side of the first drive roller 42.

In the medium conveyance device, the stopper 239 is provided and thus, even when part of the first pin part 242 runs over the first sliding groove 233, the slider 232 is prevented from detaching from the guide 231. In the medium conveyance device, the slider 232 is prevented from detaching from the guide 231 and thus, when the first pinch roller 43 is mounted, it is unnecessary to make an adjustment to prevent the slider 232 from detaching from the guide 231 and this enables easy manufacturing of the medium conveyance device.

The embodiments have been described above; however, the above description does not limit the embodiments. The components described above include components that can be easily achieved by those skilled in the art and components that are substantially the same, that is, components in the range of equivalence. Furthermore, it is possible to properly combine the above-described components. Furthermore, it is possible to perform at least one of various omissions, replacements, and changes within the scope of the embodiments.

The disclosed medium conveyance device enables accurate measurement of the thickness of an original with a pinch roller.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveyance device comprising:

a drive roller that rotates;

a guide in which a first sliding surface and a second sliding surface are formed;

a slider in which a first contact point and a second contact point are formed;

a pinch roller that is supported on the slider rotatably via a pinch shaft and that pushes an original against the drive roller; and a sensor that measures a thickness of the original based on an amount of move of the slider in a second direction that is different from a first direction in which the original is conveyed, wherein the slider is supported on the guide such that the first contact point slides on the first sliding surface and the second contact point slides on the second sliding surface and accordingly the slider is movable in the second direction, wherein a distance between the first contact point and the second contact point in the second direction is longer than a diameter of the pinch shaft, wherein the slider is supported on the guide such that the slider is fitted in a sliding groove having the first sliding surface and the second sliding surface and accordingly the slider is movable in the second direction, wherein an end of the sliding groove on a side of the drive roller is open, wherein the slider includes a first part in which the first contact point is formed; and a second part in which the second contact point is formed and that is arranged on a side that is more distant from the drive roller than the first part is, and wherein the guide includes a stopper that is engaged with the second part such that the second part does not move to the side of the drive roller with respect to a given position.

2. The medium conveyance device according to claim 1, wherein the pinch shaft is fixed to the slider, and the sensor measures the thickness of the original based on an amount of move of the pinch shaft.

3. The medium conveyance device according to claim 1, further comprising:

a switch unit that is arranged in a first position to guide the original to a first conveyance path and that is arranged in a second position to guide the original to a second conveyance path;

an actuator that causes the switch unit to move; and a controller that controls the actuator based on the thickness to cause the switch unit to be one of the first position and the second position.

* * * * *